US011548307B2

(12) United States Patent
Peng

(10) Patent No.: US 11,548,307 B2
(45) Date of Patent: Jan. 10, 2023

(54) SUBLIMATION PRINTING PRODUCTION LINE AND AUTOMATED SUBLIMATION PRINTING METHOD FOR CYLINDRICAL WORKPIECES

(71) Applicant: Photo U.S.A. Corporation, Fremont, CA (US)

(72) Inventor: James P. Peng, Fremont, CA (US)

(73) Assignee: Photo U.S.A. Corporation, Fremont, CA (US)

( * ) Notice: Subject to any disclaimer, the term of this patent is extended or adjusted under 35 U.S.C. 154(b) by 0 days.

(21) Appl. No.: 17/061,797

(22) Filed: Oct. 2, 2020

(65) Prior Publication Data

US 2022/0032672 A1 Feb. 3, 2022

(30) Foreign Application Priority Data

Jul. 29, 2020 (CN) ..... 202010741217.3

(51) Int. Cl.
*B41M 5/035* (2006.01)
*B41J 3/407* (2006.01)

(52) U.S. Cl.
CPC ..... *B41M 5/0358* (2013.01); *B41J 3/40731* (2020.08); *B41J 3/40733* (2020.08)

(58) Field of Classification Search
CPC ..... B41M 5/035; B41M 1/40; B41M 5/0082; B41F 16/00; B41J 3/40733
See application file for complete search history.

(56) References Cited

U.S. PATENT DOCUMENTS

| | | | |
|---|---|---|---|
| 3,130,107 | A | 4/1964 | Shank, Jr. |
| 3,297,508 | A | 1/1967 | Jahp |
| 3,816,221 | A | 6/1974 | Shank |
| 3,904,355 | A | 9/1975 | Takahashi |
| 4,046,936 | A | 9/1977 | Schachter |
| 4,328,268 | A | 5/1982 | Tsuji et al. |
| 4,640,191 | A | 2/1987 | Bradley |
| 4,652,337 | A | 3/1987 | Picone et al. |
| 4,662,966 | A | 5/1987 | Sumi et al. |

(Continued)

FOREIGN PATENT DOCUMENTS

| | | | | |
|---|---|---|---|---|
| CA | 2039054 | A1 | 10/1991 | |
| DE | 3935602 | A * | 5/1991 | ..... B41F 16/00 |

(Continued)

OTHER PUBLICATIONS

English translation of DE3935602.*

*Primary Examiner* — Sonya M Sengupta
(74) *Attorney, Agent, or Firm* — Stetina Brunda Garred & Brucker

(57) ABSTRACT

A sublimation printing production line for a workpiece having a cylindrical outer surface includes a sublimation paper loading station, workpiece wrapping station, a baking station, and a sublimation paper dismantling stations. The sublimation paper loading station has a workpiece conveyor belt and a sublimation paper conveyor belt that operate synchronously and in parallel. The sublimation paper is positioned on to an elastic fastening jacket, which is then tightly wrapped around the workpiece with the ends buckled together to secure the sublimation paper to the workpiece and making the sublimation image clearer, more colorful, and ensuring the quality of the sublimation.

17 Claims, 18 Drawing Sheets

(56) References Cited

U.S. PATENT DOCUMENTS 4,692,198 A 9/1987 Borresen
4,712,512 A 12/1987 Schreib et al.
4,765,581 A 8/1988 Wallace et al.
4,874,454 A * 10/1989 Talalay ..... B65C 9/34 156/481
4,943,684 A * 7/1990 Kramer ..... B65D 13/02 503/227
4,959,008 A 9/1990 Wasulko
4,989,508 A 2/1991 King
5,019,193 A 5/1991 Aramini
5,170,704 A * 12/1992 Warren ..... B41F 17/20 156/583.1
D339,267 S 9/1993 Hatt
5,296,081 A * 3/1994 Morin ..... B65C 9/24 219/535
5,308,426 A 5/1994 Claveau
5,382,313 A 1/1995 Eminger
5,395,478 A 3/1995 Sattler et al.
5,463,948 A 11/1995 Newman
5,584,961 A 12/1996 Ellsworth et al.
5,594,961 A 1/1997 Yokoi et al.
5,744,921 A 4/1998 Makaran
5,755,421 A 5/1998 Meier et al.
5,824,116 A 10/1998 Zutler
D401,808 S 12/1998 Grivsky
5,944,931 A * 8/1999 Cranford ..... B41F 16/0086 156/247
5,948,728 A * 9/1999 Patton ..... B44C 1/1716 503/227
5,962,368 A 10/1999 Poole
6,004,900 A 12/1999 O'Brien, III
6,024,650 A 2/2000 Reeves
6,047,488 A 4/2000 Tuszkiewicz
6,080,465 A 6/2000 Boissonnet et al.
6,136,126 A 10/2000 Fenzi
6,148,721 A 11/2000 Hellmeier et al.
6,186,207 B1 * 2/2001 Berghauser ..... C04B 41/009 156/583.1
6,281,165 B1 8/2001 Cranford
6,998,005 B2 2/2006 Magee et al.
7,077,926 B2 7/2006 Goffi et al.
7,137,426 B2 11/2006 Neri et al.
8,002,931 B2 8/2011 Wang et al.
8,011,922 B2 * 9/2011 Checcucci ..... C23C 14/562 432/152
8,460,498 B2 6/2013 Peng et al.
8,562,777 B2 10/2013 Drake
8,726,964 B2 5/2014 Fenzi
9,311,831 B2 4/2016 Henshue et al.
10,184,724 B2 1/2019 Anping et al.
10,245,844 B2 * 4/2019 Liu ..... B41M 1/40
2002/0066378 A1 * 6/2002 Almblad ..... G06V 20/66 101/35
2010/0186610 A1 * 7/2010 Polk ..... B41J 3/4073 101/35
2016/0290718 A1 10/2016 Ye et al.
2020/0016914 A1 * 1/2020 Bortolato ..... B41F 17/14
2022/0032672 A1 * 2/2022 Peng ..... B41J 3/40733
2022/0212461 A1 * 7/2022 Yamamoto ..... G03F 1/00

FOREIGN PATENT DOCUMENTS

DE 4432018 A1 5/1996
EP 451067 A1 10/1991
FR 2203321 A5 5/1974
GB 2224974 A 5/1990
WO 9706952 A1 2/1997
WO 9821397 A1 5/1998

* cited by examiner

SUBLIMATION PRINTING PRODUCTION LINE AND AUTOMATED SUBLIMATION PRINTING METHOD FOR CYLINDRICAL WORKPIECES

CROSS-REFERENCE TO RELATED APPLICATIONS

This application claims priority to Chinese Invention Patent Application No. 202010741217.3 entitled "A SUBLIMATION PRODUCTION LINE AND AUTOMATED SUBLIMATION PRINTING METHOD FOR REVOLVING OUTER CYLINDRICAL SURFACE" filed before China's National Intellectual Property Administration on Jul. 29, 2020, the entire content of which is incorporated herein by reference.

STATEMENT RE: FEDERALLY SPONSORED RESEARCH/DEVELOPMENT

Not Applicable

BACKGROUND

1. Technical Field

The invention relates generally to a sublimation printing production line and an automated sublimation printing method for cylindrical workpieces. More particularly, the present invention relates to an intelligent automated mechanical transmission and processing production line, and specifically a production line that prints personalized texts and images on cylindrical or other curved surfaces of a workpiece such as ceramic cups and stainless steel cups.

2. Background

Sublimation printing involves first printing a selected image on a piece of sublimation paper with a printer, then pasting the sublimation paper on the surface of the object on which the image is to be printed. The object may be ceramic, stainless steel, etc. A combined assembly of the object with the printed sublimation paper are placed in a high temperature environment of about 200 degrees Celsius for several minutes, and the special ink on the sublimation paper is sublimated and attached to the surface of the resin-coated object, thereby completing the sublimation printing process. After sublimation printing, the image on the object is colorful and vibrant, the image and the surface of the object is firmly combined, and the object becomes a highly fashionable, personalized product. Conventional sublimation printing production involves manually attaching one piece of sublimation paper to the surface of the object to be sublimation printed and then heating it to form, resulting in low production efficiency and low yield.

BRIEF SUMMARY

In order to overcome the existing technical problems, this invention proposes various embodiments of a sublimation production line and automatic sublimation printing method for workpieces with cylindrical or other irregular surfaces. The described production line and sublimation printing method may be equipped with an elastic pressing device for automatic disassembly and assembly of sublimation paper, so that the process of sublimation printing is fully automated, which not only improves the quality of image sublimation printing, but also realizes production automation. This is contemplated to reduce manual work and greatly improve production efficiency, and is envisioned as a revolutionary upgrade for the cup personalization industry.

According to one embodiment of the present disclosure, there may be a sublimation printing production line for the outer cylindrical surface of a workpiece, which successively includes: a sublimation paper loading station, a workpiece wrapping station, a baking station, and a sublimation assembly dismantling station. There are automatic production facilities between each station. The sublimation paper loading station may include a workpiece conveyor belt and a sublimation paper conveyor belt that operate synchronously in parallel. The workpiece conveyor belt is equipped with a plurality of positioning facilities for outer cylindrical surfaces of the workpiece in equal spaces. The sublimation paper conveyor belt is provided with a plurality of sublimation paper positioners corresponding to the workpiece positioners. At least one elastic fastening jacket feeding device, at least one sublimation paper feeding device, at least one sublimation paper wrapping and clamping device for tightening the sublimation paper, and at least one buckle installation device for forming the sublimation assembly may be sequentially arranged next to the sublimation paper conveyor belt. At least one workpiece end face positioning and pushing facility is provided at the position corresponding to the sublimation paper wrapping and clamping device at the rear section of the workpiece conveyor belt. The sublimation assembly dismantling station includes a finished product conveyor belt. There is at least on buckle removing device beside the finished product conveyor belt to remove the buckle from the sublimation assembly. The sublimation printing assembly may include an elastic fastening jacket for wrapping the sublimation paper on the workpiece and two buckles for fastening the elastic fastening jacket.

Further, the elastic fastening jacket may be a rubber sheet with straight support rods at both ends thereof.

The buckle may include a section of a stainless steel plate bent into a U-shaped buckle body, and the side of the U-shaped opening may define a notch for clamping the two straight support rods.

According to another aspect of the present disclosure, the workpiece positioner may be two adjacent cylindrical rods that can hold and drive a workpiece to rotate. The cylindrical rods may be interconnected with chain links.

The end face positioning and pushing station may include a lateral transposition push rod with a tension chuck on the head and end face positioning block at the bottom of the workpiece.

Further, the end face positioning device and pushing device may include: a head with a cone block capable of entering the open end of the workpiece and an end face positioning block at the bottom of the workpiece.

Further, the sublimation paper positioner may include a sublimation paper positioning tray, two short sides of the sublimation paper positioning tray being provided with sublimation paper positioning pieces, and outside the positioning piece is the positioning block, the four corners of the rectangle included in the inner side of the sublimation paper positioning piece being provided with elastic fastening jacket outer braces. In the middle of the outer side on one long side of the sublimation paper positioning tray is provided with a workpiece horizontal pushing positioning block.

Further, the sublimation paper wrapping and clamping device includes: two symmetrical pairs of X-shaped rocker arms hinged on the middle frame, and the bottoms of the two pairs of X-shaped rocker arms are respectively connected with two bottom beams, and the push-pull device is hinged between the two bottom beams, and the top ends of the two pairs of X-shaped rocker arms are provided with hooks for hooking the straight support rods.

Further, the buckle installation device includes: an automatic feeder and a feeding trough that arrange the hooks neatly, and at least one pair of holders for grabbing buckles and fastening the U-shaped buckles on two straight rods are provided above the feeding trough, vertical fully enclosed linear module horizontal guide rail and lateral fully enclosed linear module horizontal guide rail that restrict the movement of the gripper.

Further, the buckle removing device includes: a pressure block set above the finished product conveyor belt for pressing the sublimation printing assembly, the pressure block is connected with the pressure block retraction assembly, and the pressure block retraction assembly is fixed at the buckle removing beam, the buckle removing beam is fixedly connected to the rod bracket provided on the side of the finished product conveyor belt, and the rod bracket is provided with a buckle unloading retraction assembly that can drive the buckle unloading door frame to move left and right, the two door-shaped legs of the buckle-removing door frame are respectively provided with hooks capable of hooking out the buckle.

Further, the elastic fastening leather feeding device includes: horizontal guide rails fixed between the feeding tray and the sublimation paper conveyor belt, the horizontal guide rail is provided with a slide track hanger that can move along the horizontal guide rail, the slide track hanger is equipped with a mechanical arm that can move up and down along the slide track hanger, there are at least two vacuum suction cup on the top of the mechanical arm to grab the elastic fastening leather.

A sublimation printing method for the outer cylindrical surface of a workpiece using the above production line: the steps of the method are as follows:

Step 1. Loading at the paper loading station: Run the workpiece body conveyor belt and the sublimation paper conveyor belt, place the elastic fastening leather and sublimation paper on the sublimation paper by the elastic fastening leather feeding device and the sublimation paper feeding device on the sublimation paper positioning facility in order, the straight support rods at both ends of the elastic fastening leather are placed on the outside the outer brace of the elastic fastening leather, the sublimation paper is placed on the elastic fastening leather and stuck in the sublimation paper positioning piece.

Step 2, Push the cup into position: a sublimation paper positioning setting of the sublimation paper conveyor belt reach the position of the sublimation paper wrapping and clamping device, at the same time, the workpiece conveyor belt also has a workpiece positioner device that is also aligned with the position of the sublimation paper wrapping and clamping device. At this time, the workpiece on the workpiece conveyor belt is pushed to the sublimation paper positioning device on the sublimation paper conveyor belt by the workpiece end surface positioning and pushing facility, then perform end face positioning.

Step 3. Paper loading and fastening: the sublimation paper wrapping and clamping device is activated, the X-shaped rocker arm drags the two straight support rods of the elastic fastening leather to encircle the outer circle of the workpiece to make the sublimation paper on the elastic fastening leather tightly attach to the outer surface of the workpiece, the buckle installation device clamps the notches of the two U-shaped buckles to the two straight support rods of the elastic fastening leather to fix the two straight support rods and maintain the dynamic wrapping around the outer cylindrical surface of the workpiece, forming a sublimation printing assembly. After that, the workpiece lateral transposition push rod is withdrawn, and the sublimation printing assembly drops onto the sublimation paper conveyor belt and continues to move forward.

Step 4. Heat sublimation printing: The transfer facility transfers the sublimation printing assembly with sublimation paper to the mesh belt of the tunnel-type stainless steel mesh electric heating furnace at the baking station. The mesh belt of the tunnel-type stainless steel mesh electric heating furnace carries the sublimation printing assembly through the oven, and heats up to complete the image transfer.

Step 5, Paper removal: The sublimation printing facility transfers the transferred sublimation assembly to the finished product conveyor belt. The pressure block retraction assembly of the buckle removing device set beside the finished product conveyor belt presses down the press block, press down a sublimation printing assembly, at the same time, the buckle removing assembly pushes the buckle door frame forward. Insert the two hooks on the buckle removing door frame to the bottom of the notch of the buckle. The buckle removing assembly retracts, and the buckle is pulled out from the two straight support rods, so that the two straight support rods lose their restraint, the leather is automatically unfolded under the action of elasticity, so that the sublimation paper is separated from the workpiece, and the paper is removed.

The advantages and beneficial effects of the invention are that the various devices for assembling the sublimation assembly, baking and disassembling the sublimation assembly are arranged together by using a conveyor belt, so as to realize the continuous and automatic production of the sublimation-printed product. The elastic fastening leather tightly fits the sublimation paper to the body of the workpiece, making the sublimation image clearer, more colorful, and ensuring the quality of the sublimation. The small buckle makes the installation and removal more convenient. The easy-to-realize intelligent automated production improves the production efficiency of the sublimation printing.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present disclosure encompasses various embodiments of a sublimation printing production line and automatic sublimation printing methods for a workpiece with a cylindrical or other curved surface. The detailed description set forth below in connection with the appended drawings is intended as a description of the several presently contemplated embodiments and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
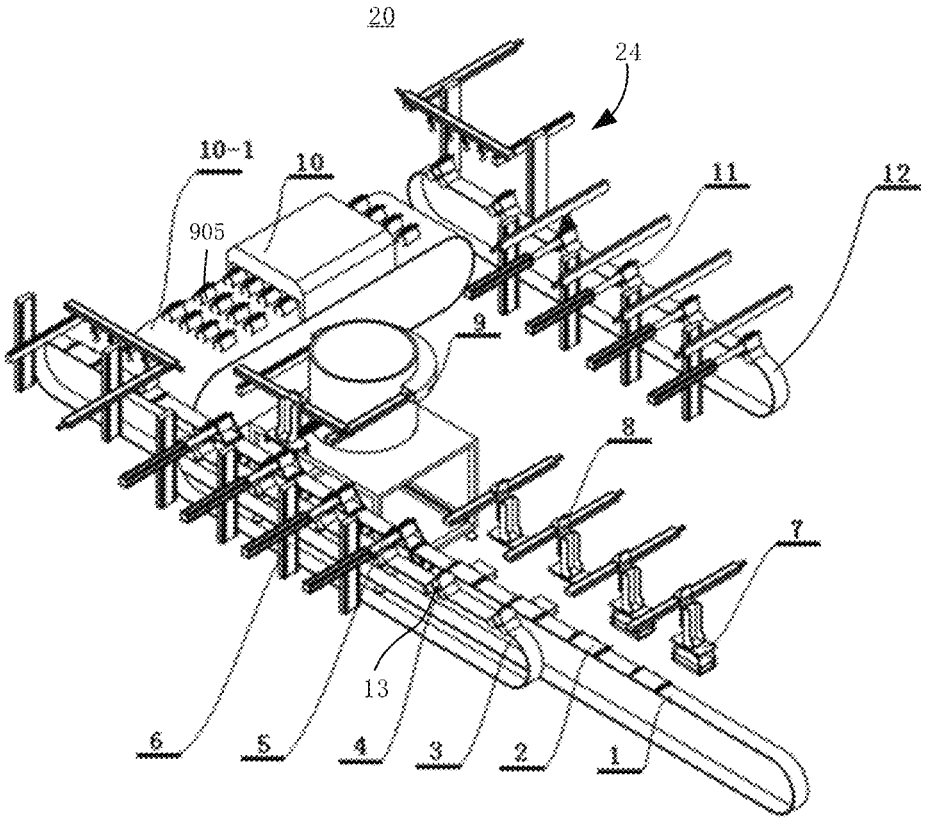
FIG. 1 is a perspective view of a sublimation printing production line for a cylindrical or other curved surface of a workpiece according to an embodiment of the present disclosure.

First Aspect:

One aspect of this disclosure is a sublimation printing production line 20 for a workpiece 13 with a cylindrical or other curved outer surface, as shown in FIG. 1. In the illustrated example, the workpiece 13 is a ceramic mug, though any other workpiece having curved, or straight outer surfaces may be substituted without departing from the scope of the present disclosure. As illustrated, the sublimation printing production line 100 may include the following stations in sequence along the movement direction of the production line: manual inspection of cup quality or automatic inspection, a cup positioning station, sublimation paper loading station, cup wrapping station, baking station, paper dismantling stations, finished products unloading stations. Automatic transfer functions may be provided between each station. The workpiece conveyor belt 3 is provided with one or more workpiece positioners 4, and a sublimation paper conveyor belt 1 is provided with one or more sublimation paper positioners 2 that may be spaced correspondingly or in alignment with the workpiece positioners 4. Next to the sublimation paper conveyor belt 1 there may be at least one elastic fastening jacket feeding device 7, at least one sublimation paper feeding device 8, at least one sublimation paper wrapping and clamping device 6 for coupling the sublimation paper to the workpiece 13, and at least one buckle installation device 9, which may collectively comprise the sublimation printing production line 20 arranged in sequence.

Figure 2:
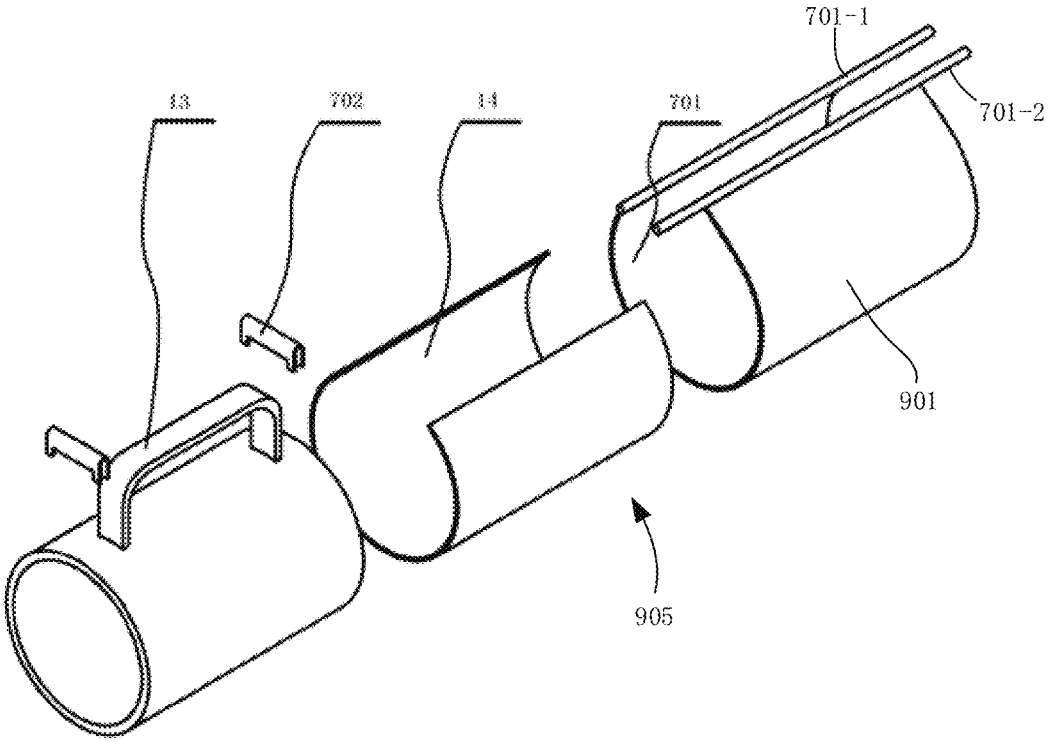
FIG. 2 is an exploded perspective view of a workpiece, a sheet of sublimation paper, and an elastic fastening jacket that are assembled together in one station of the sublimation printing production line of the present disclosure.
Figure 3:
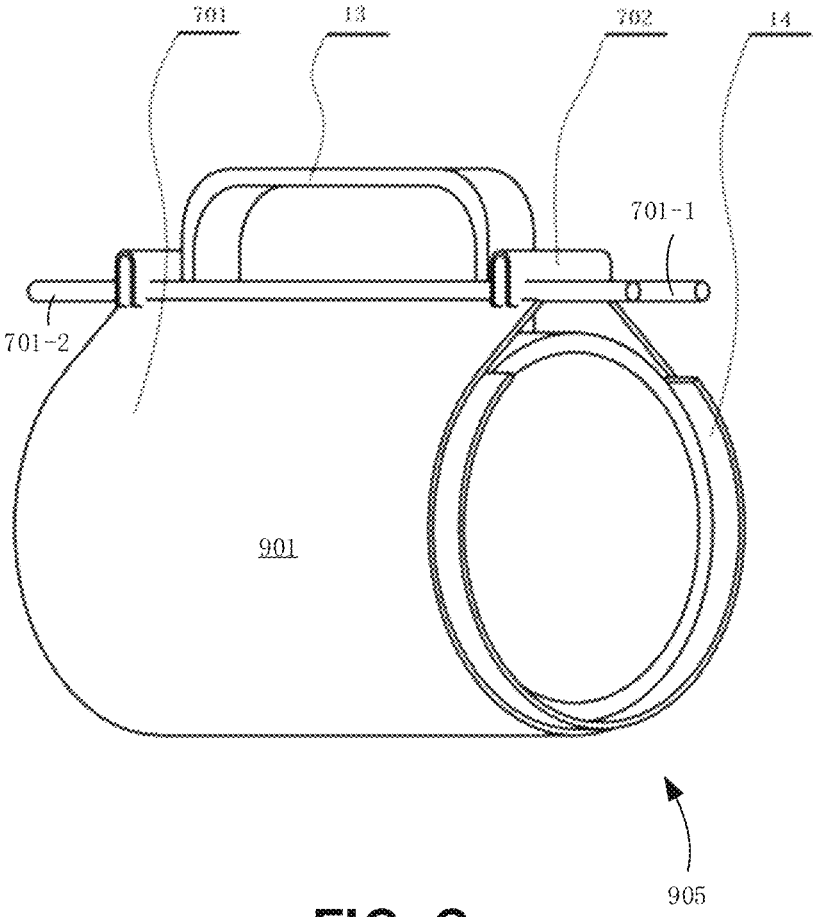
FIG. 3 is a perspective view of the workpiece, the sheet of sublimation paper, and the elastic fastening jacket as shown in FIG. 2 but in assembled form according to an embodiment of the sublimation printing production line of the present disclosure.

At least one workpiece end face positioner/pusher 5 is provided at a position corresponding to the sublimation paper wrapping and clamping device 6 adjacent to the rear section of the workpiece conveyor belt 3. The sublimation paper dismantling station 24 includes a finished product conveyor belt 12. At least one buckle removing device 11 for disassembling the workpiece/sublimation paper assembly is provided adjacently to the finished product conveyor belt 12. As shown in FIGS. 2 and 3, the sublimation printing production line 20 includes an elastic fastening jacket 701 that can wrap the sublimation paper 14 on to the outer cylindrical surface of the workpiece 13, and two buckles 702 for fastening the ends of the elastic fastening jacket 701 together.

The basic process of the sublimation printing in this embodiment is to attach the sublimation paper 14 to the workpiece 13 tightly, bake, and then separate the sublimation paper 14 from the workpiece 13. In support of these general operational steps, there may be a cup positioning station, a sublimation paper loading station, a workpiece wrapping station, a baking station, a sublimation paper removing station, and finished product unloading station. The modality by which the workpiece 13 is transferred from station to station, or to load/position the sublimation paper 14 or other components at each station may be a robotic arm with clamps or vacuum suction cups.

It should be noted that the generatrix of the workpiece described in this embodiment is illustrated as a straight line, or at least the generatrix of the surface of the workpiece 13 for sublimation printing is a straight line. The workpiece 13 may be hollow, such as a cup, a bottle, or other vessel that can hold liquid or other substances. The material of the workpiece may be ceramic, stainless steel, or other surface on which ink may be sublimated. The workpiece 13 may have a handle on one side, such as is the case with a mug with a handle, though this is optional.

The sublimation paper loading station will now be considered in further detail. There are two conveyor belts, with one being dedicated to conveying the workpiece 13, and the other being dedicated to conveying the elastic fastening jacket 701 and the sublimation paper 14. The workpiece conveyor belt 3 is provided with a positioning device for the outer cylindrical surface of the workpiece 13. Since the shape of the workpiece is a cylinder in the illustrated embodiment, if the workpiece is a cup, a cup handle may be provided on the cylinder side thereof. The position of the cup handle may be vertically upward. The end face of the workpiece 13 can be positioned by a positioning block, or a PC control system can be used to control a servo motor and an infrared detection to detect the cup handle to ensure vertical positioning. If it is a metallic cup without a handle, an auxiliary fixed mold may be utilized.

It should be noted that the center of rotation of the workpiece 13 is perpendicular to the moving direction of the workpiece conveyor belt 3, and the two end faces of the cylinder face the left and right sides of the same.

The positioning device for the outer cylindrical surface of the workpiece 13 can be in the form of pairs of cylindrical rubber rods, pairs of cross-sectionally triangular rods, and the like. The rubber rods of the positioning device for the external cylindrical surface of the revolving body can also be made to be rotatable, and each rubber rod is hingedly connected with a chain, so that the rotation of the rubber rod can be used to adjust the position of the cup handle to provide proper condition for wrapping and clamping the sublimation paper 14. The sublimation paper positioner can include a plurality of trays for holding the sublimation paper and may move together with the sublimation paper conveyor belt 1. In preferred, though optional embodiments, the size and shape of the trays may correspond to the size and shape of the sublimation paper and being slightly larger than the sublimation paper while having the same shape as the sublimation paper. For example, the sublimation paper may be rectangular, and the tray may likewise be rectangular. The elongate side of the rectangle is consistent with the moving direction of the sublimation paper conveyor belt 1, and the short side of the rectangle may be perpendicular to the moving direction of the sublimation paper conveyor belt 1.

It should be noted that the front, back, left, and right positions referenced herein corresponds to the movement direction of the items on the conveyor belts 1, 3 relative to the same. The forward direction of the conveyor belt is forward and the reverse direction is backward. The sides of the conveyor belt are left and right.

Sublimation printing is understood to be optimal when the sublimation paper is tightly attached to the surface that is to be printed. For this embodiment, the sublimation paper is tightly attached to the outer cylindrical surface of the workpiece 13 to achieve a clear effect of sublimation printing. Thus, this embodiment may include an elastic fastening jacket 701, and more particularly, an elastic sheet 901. In the illustrated configuration, the elastic sheet 901 may have a rectangular configuration with a two opposed short sides and two opposed long sides perpendicular thereto. The rectangular configuration of the elastic sheet 901 is presented by way of example only and not of limitation, and any other suitable shape may be substituted. Furthermore, the elastic sheet 901 may be constructed of any suitably stretchable/elastic material such as rubber, though again, this is presented by way of example only.

The two short sides of the elastic sheet 901 are provided with straight support rods 701-1 and 701-2, which may be engageable to pull and stretch the elastic sheet 901 toward each of the respective opposing edges thereof. The length of the long side of the elastic sheet 901 may be less than the circumferential length of the outer cylindrical surface of the workpiece 13. When the elastic sheet surrounds the outer cylindrical surface of the workpiece 13, as long as the two straight support rods 701-1 and 701-2 are pulled towards each other, the elastic sheet 901 can be tightly wrapped on the workpiece 13.

In order to pull the two straight support rods 701-1 and 701-2 toward each other and lock each other into position, there may be two buckles 702 on the periphery of the two straight support rods 701-1 and 701-2 so that they cannot be separated, and the workpiece 13, the sublimation paper 14, and the elastic fastening jacket 701 are fixed together to form a sublimation assembly 905, as shown in FIG. 2 and FIG. 3.

The distance between two adjacent workpiece positioners 4 on the workpiece conveyor belt 3 is equal to the distance between two adjacent sublimation paper positioners 2 on the sublimation paper conveyor belt 1. When the two conveyor belts are running, each workpiece positioner 4 and sublimation paper positioners 2 are in synchronous movement face to face. In this way, the workpiece on the workpiece conveyor belt 3 can be accurately pushed to the sublimation paper positioner 2 on the sublimation paper conveyor belt 1 under the force of a workpiece positioning and pushing system 907, so that the two are combined together.

The workpiece positioning and pushing system 907 is understood to have two functions, one is to push the workpiece 13 from the workpiece conveyor belt 3 to the sublimation paper conveyor belt 1. Since the workpiece conveyor belt 3 is equipped with the workpiece positioner 4, as long as the workpiece conveyor belt 3 and the sublimation paper conveyor belt 1 can be accurately synchronized, the workpiece 13 from the workpiece conveyor belt 3 to the sublimation paper conveyor belt 1 can also be accurately positioned. However, the position of the workpiece 13 may still need to be adjusted after it is pushed from the workpiece conveyor belt 3 to the sublimation paper conveyor belt 1. Therefore, the second function of the workpiece positioning and pushing system 907 is to accurately place the end surface of the workpiece 13 at the correct position and accurately wrap the sublimation paper 14 and the elastic fastening jacket 701.

One component of the workpiece positioning and pushing system 907 is a horizontal transposition push rod 5. According to different workpiece body shapes, such as a mug, a horizontal transposition push rod 5 with a tension chuck on the head can be used. An embodiment of the workpiece positioning and pushing system 907 configured for bottles with narrower bodies may utilize a horizontal transposition push rod 5, a pushing block that is slighter larger than the mouth of the bottle may be used.

A workpiece feeding device beside the workpiece conveyor belt 3 can be manual feeding or mechanical arm feeding.

Since both the sublimation paper 14 and the elastic fastening jacket 701 are flexible, such components may be placed in the tray separately, and a vacuum suction cup on a manipulator may be used to capture, retain while moving, and place the sublimation paper 14 and/or the elastic fastening jacket 701 in the sublimation paper positioning tray. The elastic fastening jacket 701 may be placed first, and then the sublimation paper 14 may be placed thereafter. It is also possible to use a material pushing technique to push the sublimation paper 14 or the elastic fastening jacket 701 into the tray of the sublimation paper positioner 2.

The sublimation paper wrapping and clamping device 6 combines the elastic fastening jacket 701, the sublimation paper 14, the workpiece 13, and the buckle 702 to form the sublimation assembly 905, as shown in FIG. 2, FIG. 3. One contemplated aspect is to roll up the elastic fastening jacket 701 around the workpiece 13 so that the sublimation paper 14 is tightly wrapped around the outer cylindrical surface of the workpiece 13. The action of the sublimation paper wrapping and clamping device 6 is to drive the straight support rods 701-1 and 701-2 at the front and back side of the elastic fastening jacket 701 to surround the revolving body. This action can be realized by using an X-shaped structure or other similar X-shaped structures as will be described in further detail below.

The buckle installation device 9 is couple the buckle 702 on the two straight support rods 701-1 and 701-2 of the elastic fastening jacket 701. Due to the small size of the buckle, a device similar to a vibrating conveyor can be used to arrange the same neatly, and then transport it to the sublimation paper conveyor belt 1 through a conveying groove, and then use the manipulator to lift the buckle 702 and insert it between the two straight support rods 701-1 and 701-2. The size of the buckle 702 is determined by the diameter of the workpiece 13, the length of the elastic fastening jacket 701, and the desired degree of tightness with which the sublimation paper 14 is wrapped around the workpiece 13.

The horizontal transposition push rod 5 pushes the workpiece 13 as actuated by a push-pull device, and the telescopic motion can be adjusted according to the size of the workpiece 13. The head of the horizontal transposition push rod 5 may be equipped with an expansion mechanism. When the expansion mechanism is expanded, different molds can be replaced according to different workpiece types to retain the specific workpiece 13 and achieve accurate front and back positioning (forward and backward along the conveyor belt movement direction). At the same time, the second function of the horizontal transposition push rod 5 is to push the workpiece 13 from the workpiece conveyor belt 3 to the sublimation paper conveyor belt 1 so as to combine with the sublimation paper 14 and other parts to form the sublimation assembly 905. The expansion mechanism can be realized by the method of slope shift, that is, to use the forward movement to drive a plum petal to expand to realize the expansion.

The baking station can be set to continuous baking. In one implementation, the baking station may be a tunnel-type stainless steel mesh belt electric furnace conveyor belt that is used as a mobile baking support, and the sublimation assembly 905 is placed on the baking support to pass through the oven. Such continuous baking is contemplated to improve efficiency. The tunnel-type stainless steel mesh belt electric furnace is composed of a chain conveyor made of heat-resistant steel and a high-temperature tunnel kiln. The conveyor belt may be a high-temperature-resistant metal belt, and high-power gold-plated infrared heating is used to ensure a stable temperature. It may be equipped with a unique air distribution device to make the hot air evenly distributed to ensure product consistency, as well as a material cooling system.

One feature of the sublimation paper dismantling station 24 is the buckle removing device 11. Since the buckle 702 is used to connect the two straight support rods 701-1 and 701-2 by using the elasticity of the elastic fastening jacket 701, once the buckle 702 is removed from the straight support rods 701-1 and 701-2, the elastic fastening jacket 701 will be unfolded and the sublimation assembly 905 can be dismantled by a simple action of removing the buckle 702 with the push-pull device.

In this embodiment, the elastic fastening jacket feeding device 7, the sublimation paper feeding device 8, the sublimation paper wrapping and clamping device 6, the buckle installation device 9, the horizontal transposition push rod 5, and the buckle removing device 11 may be a complete set to constitute, at least in part, an assembly and dismantling system for the sublimation assembly 905. Multiple sets of such system can be set up to improve production efficiency. For example, four sets of such systems can be set up to process four workpieces concurrently to increase production output and efficiency.

One or more of the push-pull devices in the various embodiment of the present disclosure may adopt pneumatic actuators, hydraulic actuators, or electro-mechanical actuators to move the push rods. In order to ensure the stability of the equipment, the electro-mechanical actuators can be implemented with servo motors. The guide rails can be sliding guide rails or rolling guide rails. The rolling guide rail can be a fully enclosed modular guide rail. The push-pull device that controls the mechanical components in the servo system may be a device that assists the indirect speed change of the motor. The rotor speed of the servo motor may be controlled by a signal, and the position may be precisely controlled thereby. In order to ensure the stability of the unloading station of the finished product and reduce labor, industrial cameras can be used to control the robotic arms. It can replace the human eye for measurement and judgment on the assembly line. The digital image capture target is converted into an image signal and sent to a dedicated image processing system. The image system performs various operations on these signals to extract the features of the target, and then controls the device actions of the field devices according to the judgment result. The control system can adopt programs or sequence control systems such as industrial PC or PLC with high reliability, strong anti-interference ability, simple operation which is convenient and quick, or other electronic equipment with digital storage and processing capabilities.

Figure 4:
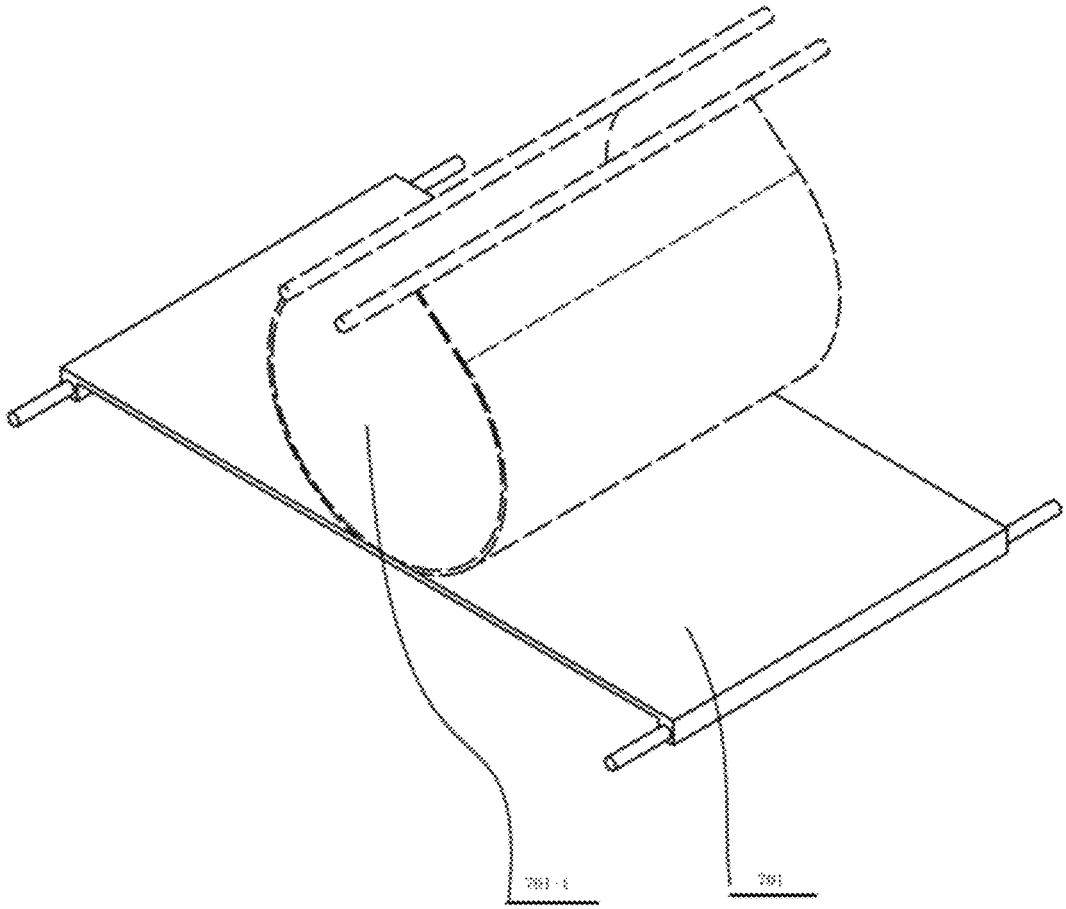
FIG. 4 is a perspective view of an elastic fastening jacket according to an embodiment of the sublimation printing production line of the present disclosure.

Second Aspect:

A second aspect of the present disclosure contemplates further improvements to sublimation printing production line 20 discussed above and relates to a further refinement of the elastic fastening jacket discussed above in the context of the first embodiment. With reference to FIG. 4, the elastic fastening jacket 701 is an elastic sheet 901 with the straight support rod 701-1 at both ends.

The straight support rod 701-1 is understood to have a certain strength and bending resistance, and can be made of 304 stainless steel, though any other suitable material may be substituted without departing from the scope of the present disclosure. The elastic sheet 901 is understood to constructed of a material that has elasticity while being resistant to high-temperature aging such that the image on the sublimation paper will not penetrate the same due to high temperature.

Figure 5:
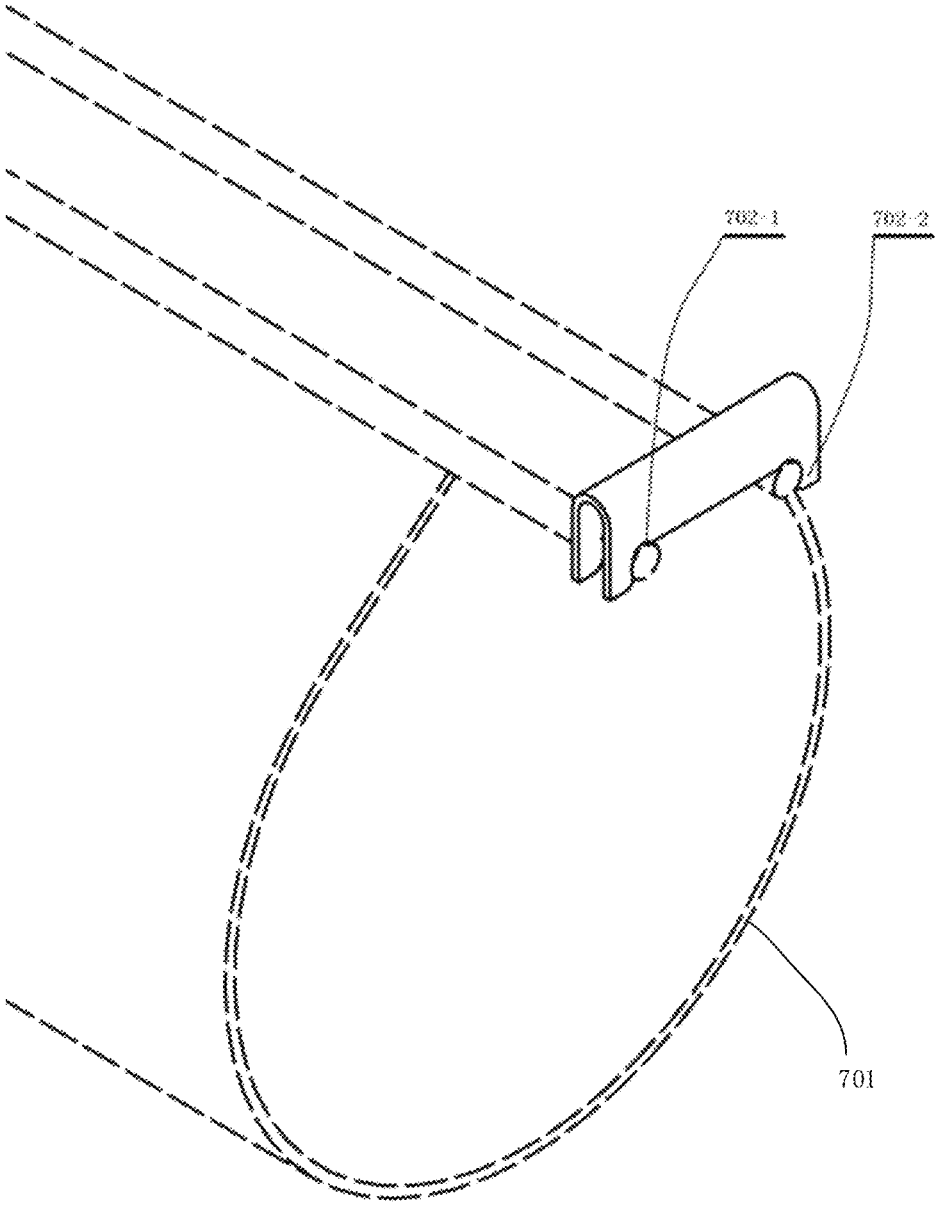
FIG. 5 is a detailed perspective view of a U-shaped buckle in accordance with an embodiment of the sublimation printing production line of the present disclosure.

Third Aspect:

A third aspect of the present disclosure contemplates a further refinement with respect to the buckle 702. In further detail, as shown in FIG. 5, one embodiment of the buckle 702 is understood to have a U-shaped configuration with notched ends that are engageable to the straight support rods 701-1 and 701-2. The buckle 702 in this embodiment is stamped and bent from a piece of metal plate customized according to the diameter of the cup body, the cross-sectional shape in the section perpendicular to the direction of the conveyor belt is U-shaped. The side shape is a gap in the middle, with protrusions on both sides, forming two hooks 702-1. At the junction of the bottom of the gap and the hooks, there is an arc-shaped transition section 702-2 to accommodate the straight support rod 701-1 that makes the two protrusions constrain the straight support rod to the bottom of the gap.

Figure 6:
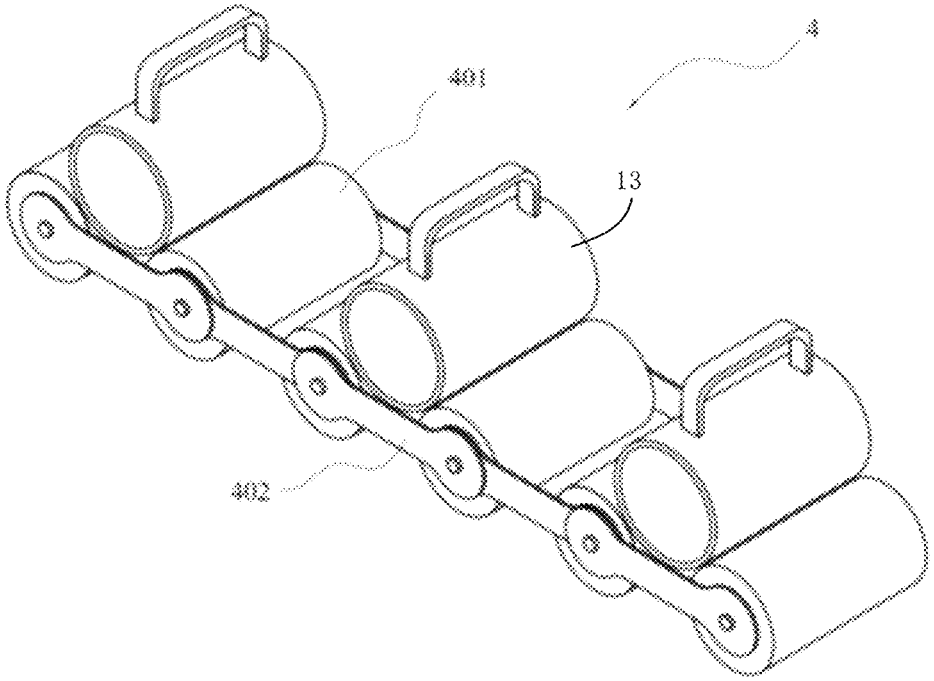
FIG. 6 is a detailed perspective view of a workpiece positioner according to another embodiment of the sublimation printing production line of the present disclosure.

Fourth Aspect:

According to a fourth aspect of the present disclosure, a further an improvement of the above-mentioned embodiment contemplates refinement regarding the workpiece positioner 4. Specifically, FIG. 6 illustrates the workpiece positioner 4 in this embodiment including two adjacent cylindrical rods 401 that hold up the workpiece and the cylindrical rods 401 are hingedly connected.

The two adjacent cylindrical rods 401 are equivalent to two positioning blocks, and a workpiece is placed between them. Each cylindrical rod 401 is connected by a chain plate 402, as shown in FIG. 6. The workpiece positioner 4 may be specifically configured for a cup with a cup handle on the workpiece. When the cup handle is not upright, the cylindrical rod 401 can be rotated by a servo motor with feedback from an infrared sensor to precisely to adjust the direction of the cup handle. The advantage of using two cylindrical rods for positioning is that, it not only has the ability to adjust the position of the cup, but also it is not sensitive to the size of the outer diameter of the workpiece, which means as long as the outer diameter of the workpiece changes within a certain range, the two cylindrical rods can be installed for a wide range of workpiece sizes without adjusting the distance between the two. The cylindrical rods 401, or at least those portions thereof that engage the workpiece, may be constructed of rubber or any other suitable material with a sufficient coefficient of friction to grip the workpiece 13.

Figure 7:
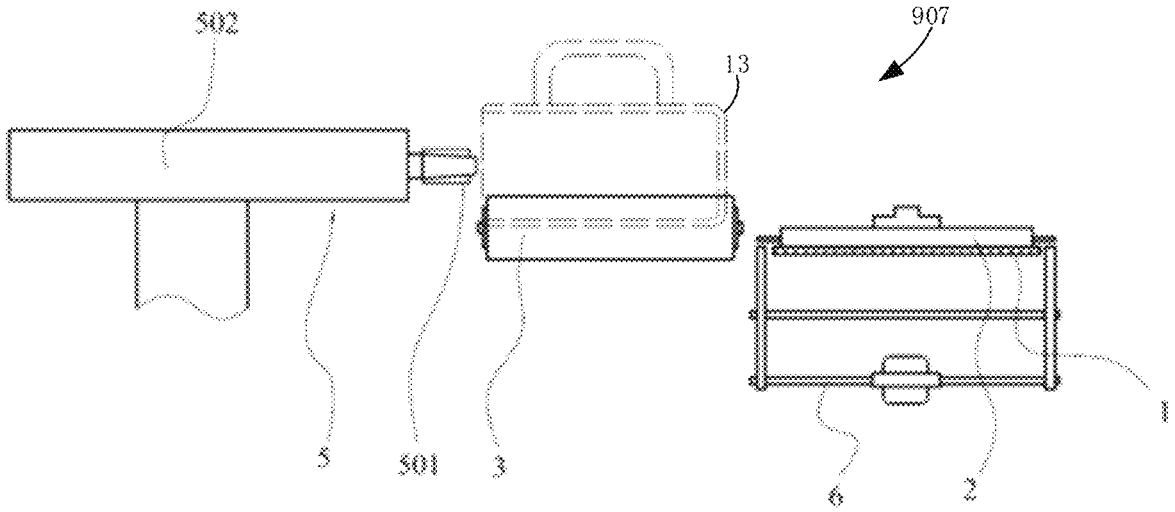
FIG. 7 is a front view of the workpiece positioning and pushing system engaging with an end face of the cylindrical workpiece according to another embodiment of the present disclosure with the cylindrical workpiece being located on a workpiece conveyer belt for placement on to the sublimation paper and workpiece assembling station.
Figure 8:
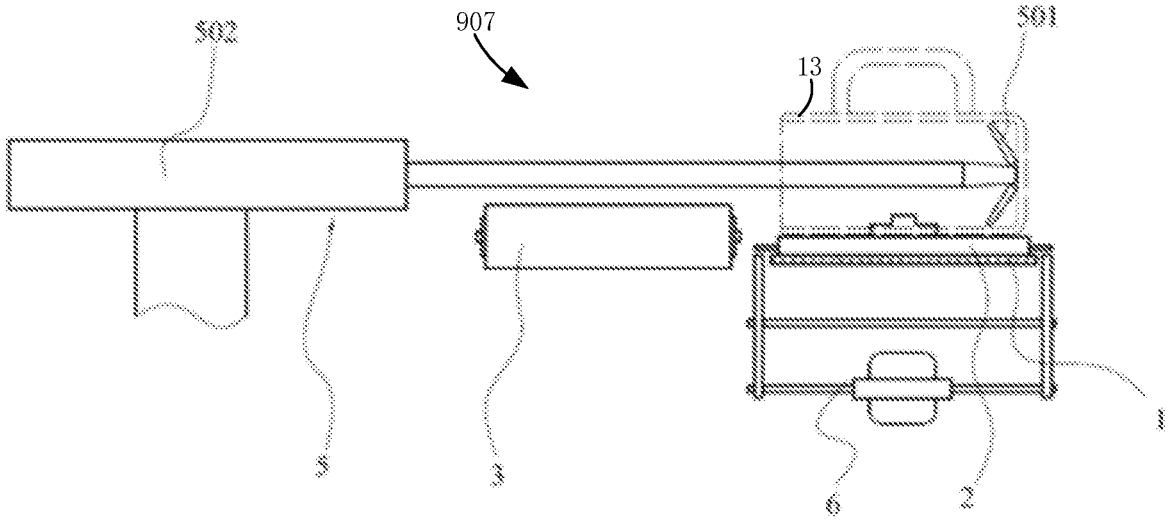
FIG. 8 is a front view of the workpiece positioning and pushing system for the end face of a cylindrical workpiece in the form of a cup, with the cups being located on the workpiece conveyer belt.

Fifth Aspect:

According to a fifth aspect of the present disclosure, a further refinement to the workpiece positioning and pushing system 907 is contemplates a horizontal transposition push rod 502 with a tension chuck 501 on the head. As shown in FIGS. 7 and 8, one objective of this refinement is directed to wide-mouth workpiece, such as a mug. The head of the horizontal transposition push rod 5 is provided with a tension chuck 501. When the horizontal transposition push rod 5 is not inserted into the cup/workpiece 13, the tension chuck 501 is retracted. As shown in FIG. 8, when the horizontal transposition push rod 5 is inserted into the cup/workpiece 13, the tension chuck 501 is opened, the cup is supported by the tension force and the cup is pushed from the workpiece conveyor belt 3 to the sublimation paper conveyor belt 1. For more accurate positioning, a workpiece bottom positioning block can be provided at the bottom of the cup as an axial constraint thereon.

Figure 9:
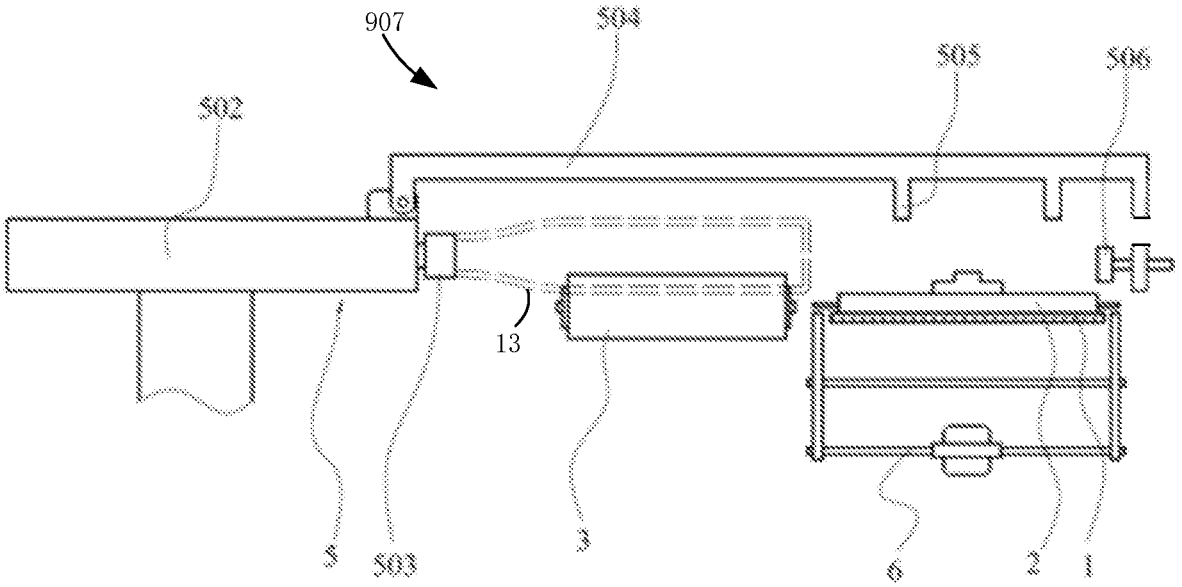
FIG. 9 is a front view of the workpiece positioning and pushing system for the end face of an exemplary cylindrical workpiece in the form of a bottle without a cup handle, with such workpieces being located on the workpiece conveyer belt.
Figure 10:
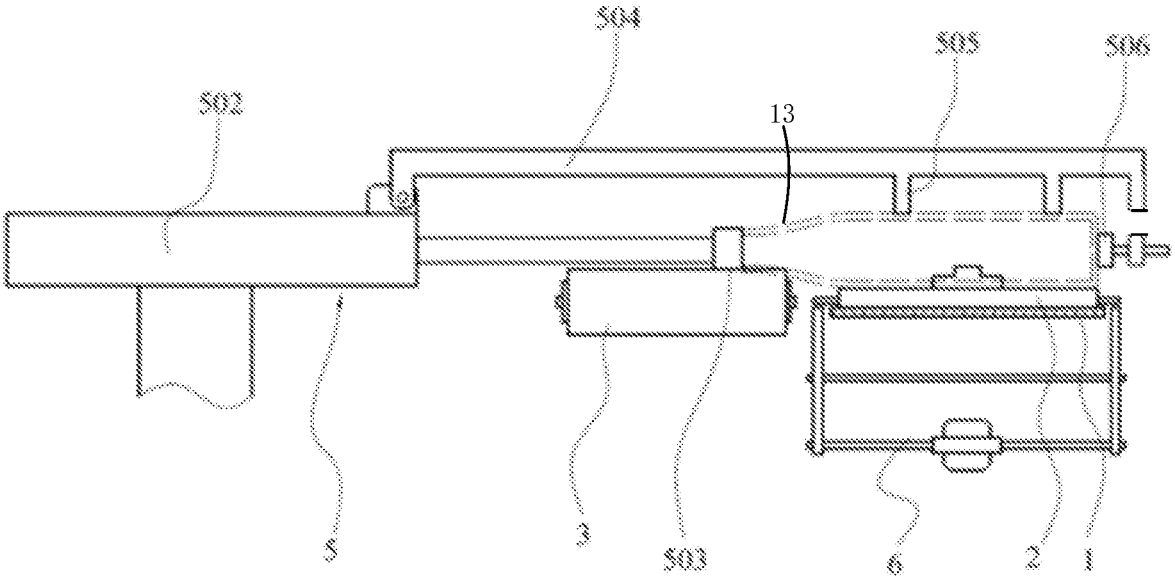
FIG. 10 is a front view of the workpiece positioning and pushing system for the end face of the cylindrical workpiece as shown in FIG. 8, with the workpiece being located on a sublimation paper conveyer belt.

Sixth Aspect:

A sixth aspect of the present disclosure is directed to a further refinement of the above-mentioned feature regarding the workpiece positioning and pushing system 907, which may include: a horizontal transposition push rod 502 with a push block 503 on the head that supports the open side of the workpiece 13, and the horizontal transposition push rod 5 is hingedly connected to the positioning beam 504. As shown in FIGS. 9, 10, and 11, the positioning beam 504 is provided with a pressing rod 505 and an end face positioning block 506 at the bottom of the workpiece 13.

Figure 11A:
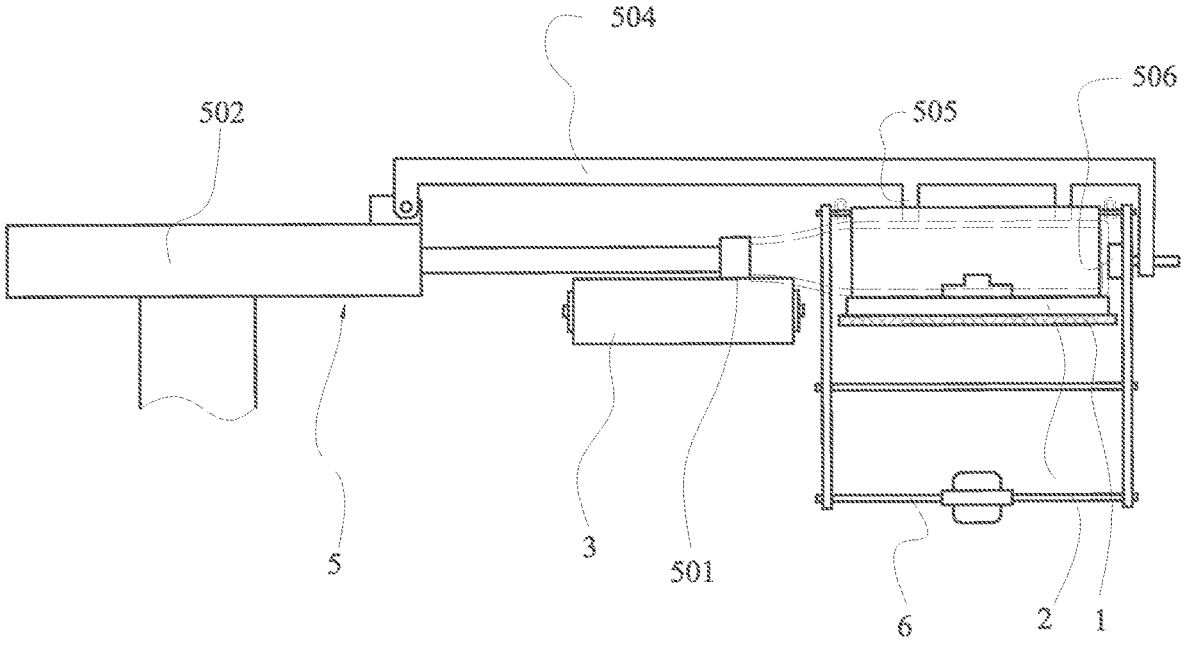
FIG. 11*a* is a front view of the workpiece positioning and pushing system for the end face of the exemplary workpiece without a cup handle, with a positioning beam partially raised.
Figure 11B:
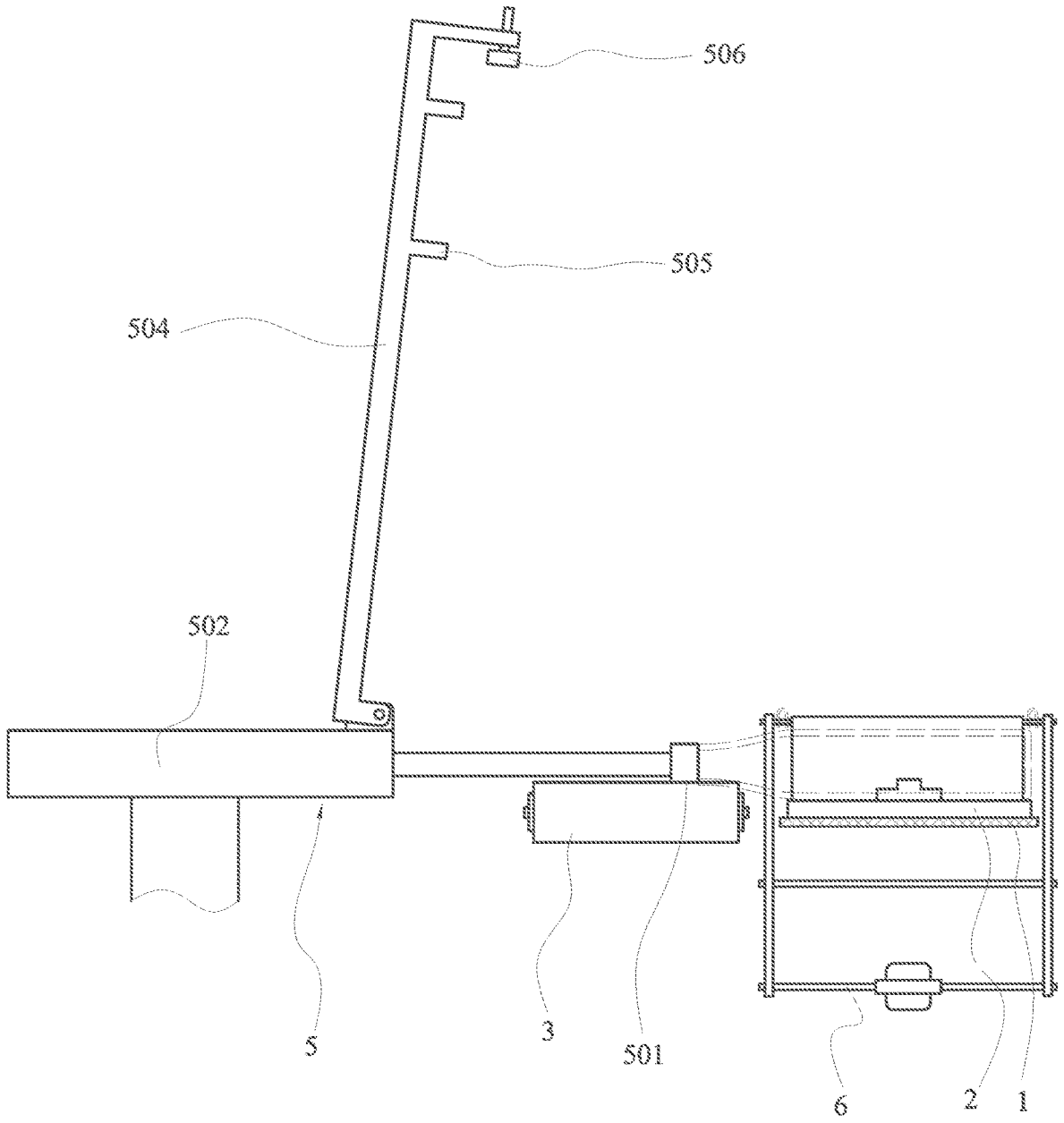
FIG. 11*b* is a front view of the workpiece positioning and pushing system for the end face of the exemplary workpiece without a cup handle with the positioning beam fully raised.

This feature is configured for accommodating a bottle type workpiece with a slender and small mouth, such as a soda bottle, or a cup without a handle, such as stainless steel tumbler. The head of the horizontal transposition push rod 5 is provided with a positioning block that can be received by the mouth of the bottle or the cup. The positioning block pushes the bottle or the cup towards the direction of the sublimation paper conveyor belt 1 under the force of the push rod, as shown in FIG. 9. The workpiece 13 is pushed workpiece conveyor belt 3 to the sublimation paper conveyor belt 1. At this time, the positioning beam 504 is in a horizontal orientation, and the end face positioning block 506 at the bottom of the workpiece 13 is aimed to the bottom of the bottle or cup to restrain the bottle or cup from moving towards the direction of the sublimation paper conveyor belt 1 to complete the shift and positioning, as shown in FIG. 10. After a complete positioning operation, the wrapping and clamping device 6 begins to operate. The workpiece 13 may be lifted because of the wrapping and clamping action. At this time, the pressing rod 505 is contemplated to prevent the lifting action of the workpiece 13. When the wrapping and clamping device 6 is almost completed, the positioning beam 504 is lifted as shown in FIGS. 11*a* and 11*b*, to avoid interference with the buckle 702 on the sublimation paper wrapping and clamping device 6.

Figure 12:
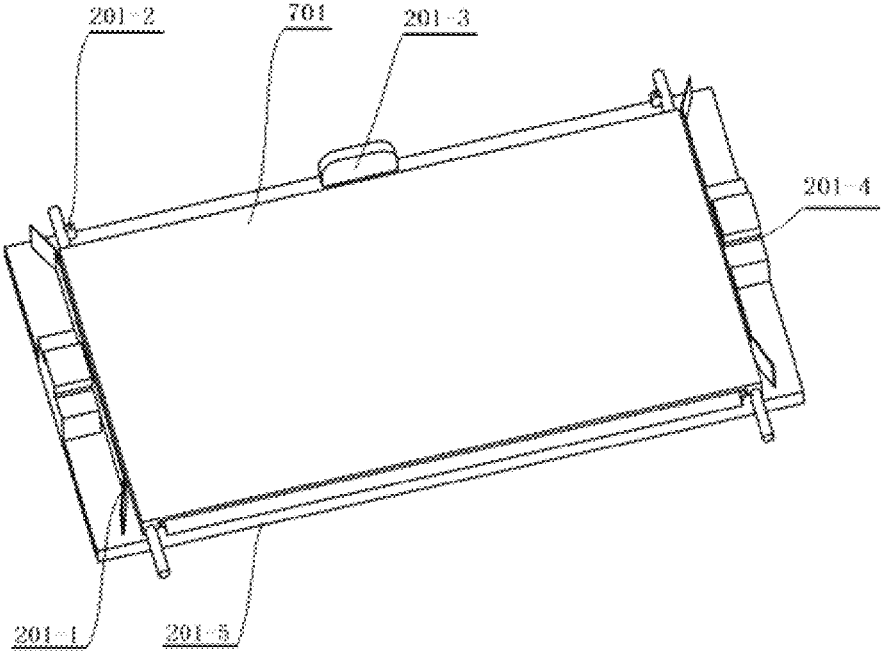
FIG. 12 is an upper perspective view of a sublimation paper positioner according to another embodiment of the present disclosure.

Seventh Aspect:

A seventh aspect of the present disclosure is envisioned as a further refinement of the sublimation paper positioner 2 discussed above, which, as shown in FIG. 12, includes: a sublimation paper positioning tray 201-5, a sublimation paper positioning piece 201-1 disposed on the two short sides of the sublimation paper positioning tray 201-5, and a sublimation paper positioning block 201-4 provided outside of the sublimation paper positioning piece 201-1. The four inner corners of the rectangular sublimation paper positioning tray 201-5 include elastic fastening jacket outer braces 201-2. In the middle of the outer side on one long side of the sublimation paper positioning tray 201-5 there is provided a workpiece horizontal pushing and positioning block 201-3.

One component of the sublimation paper positioner 2 is a sublimation paper positioning tray 201-5 to hold the sublimation paper 14 and the elastic fastening jacket 701. In order to accurately position the sublimation image at the correct position of the workpiece 13, the sublimation paper positioning tray 201-5 is equipped with multiple positioning features. First is the sublimation paper positioning piece 201-1, second, outside of the sublimation paper positioning piece 201-1 there is the sublimation paper positioning block 201-4, the four corners on the inner side of the sublimation paper positioning piece 201-1 include the pushing and positioning block 201-3, and lastly in the middle of the outer side on one long side of the sublimation paper positioning tray 201-5 includes a workpiece horizontal pushing and positioning block 201-3.

Figure 13:
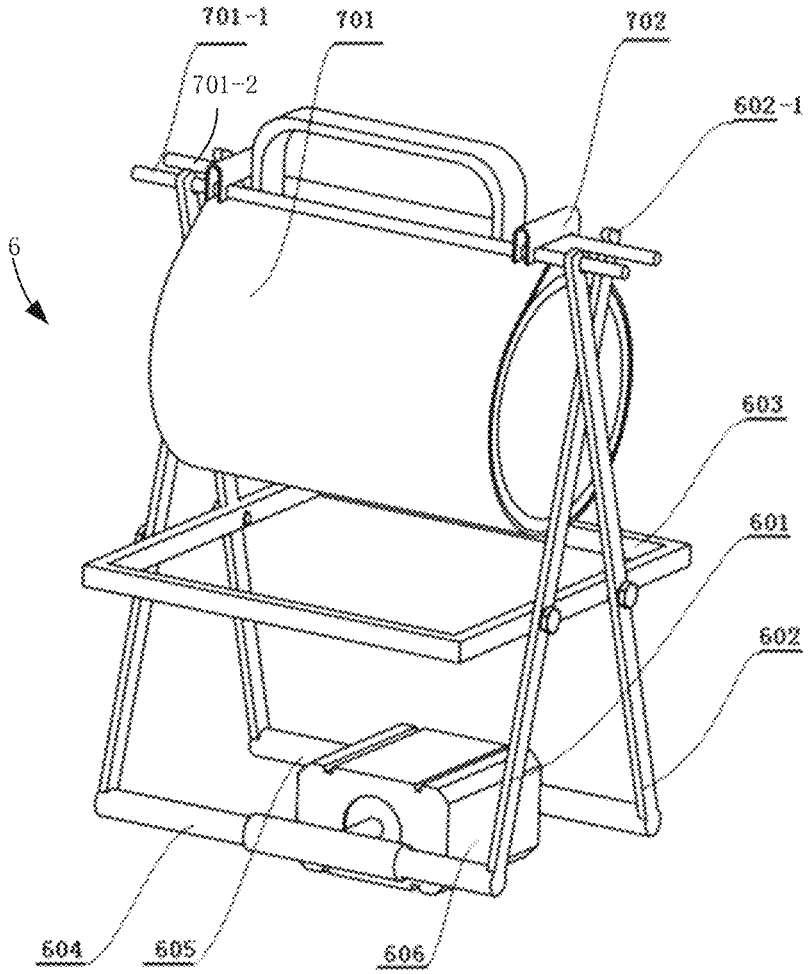
FIG. 13 is a perspective view of a sublimation paper wrapping and clamping device according to an embodiment of the present disclosure, the device being in a closed position.
Figure 14:
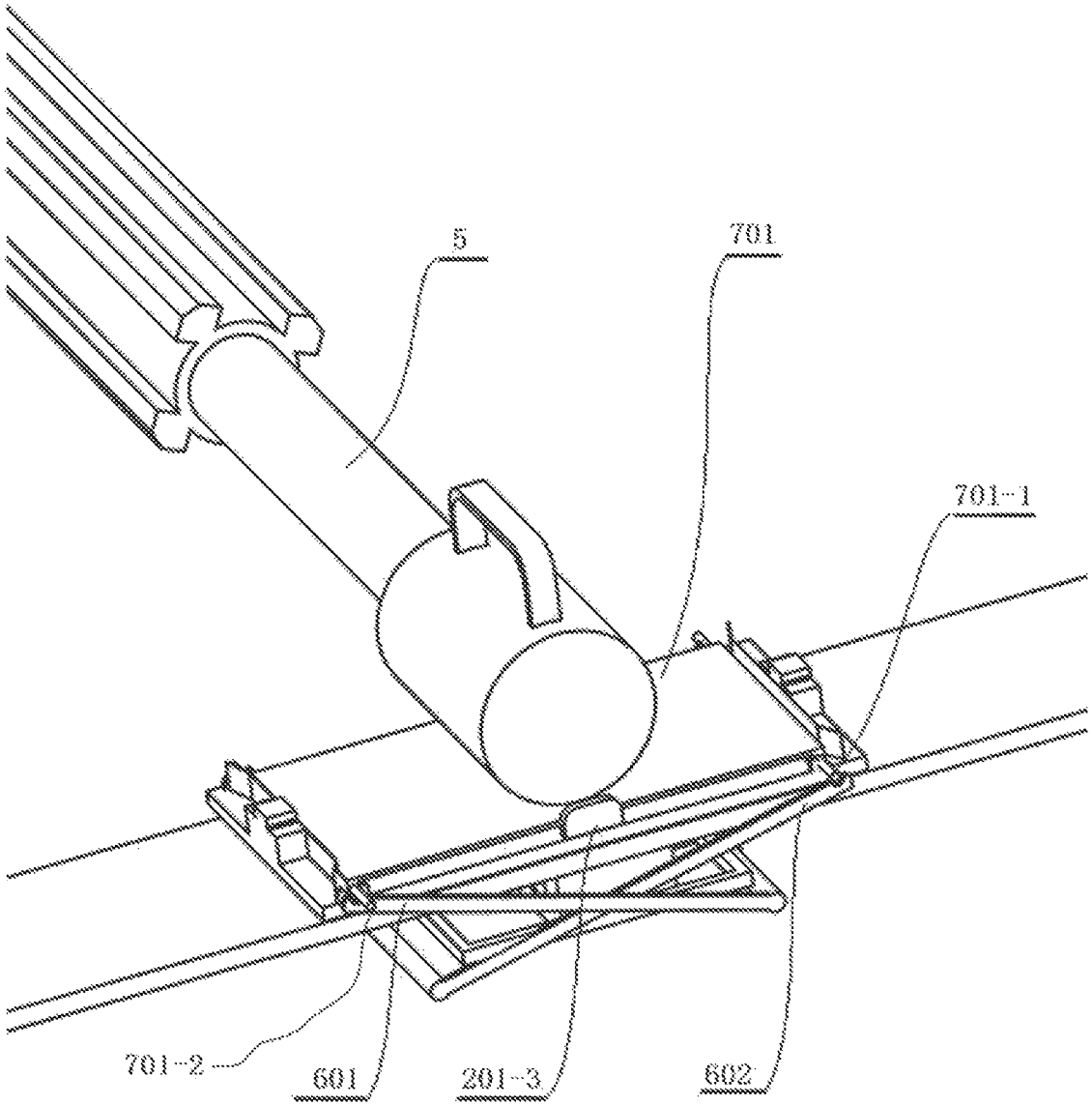
FIG. 14 is a detailed perspective view of the sublimation paper wrapping and clamping device according to an embodiment of the present disclosure, with the device being in an opened position.
Figure 15:
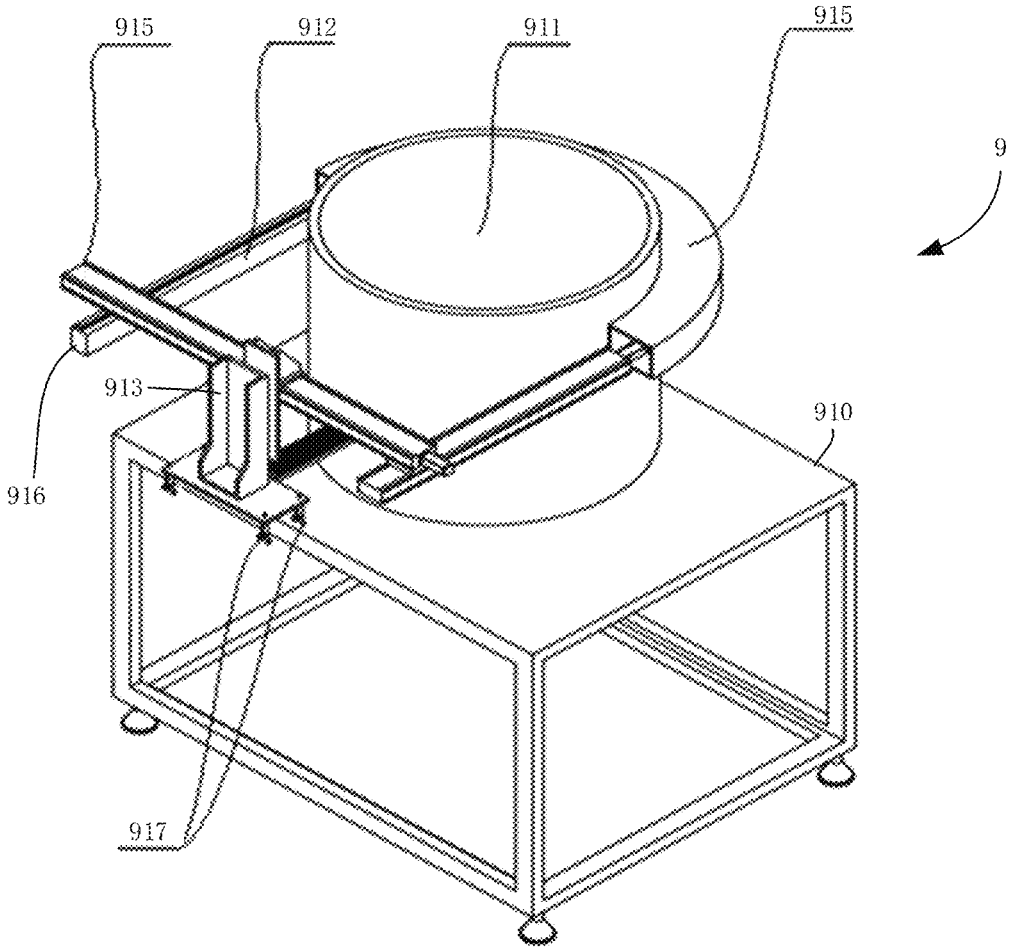
FIG. 15 is a perspective view of a buckle installation device according to another embodiment of the present disclosure.

Eighth Aspect:

An eighth aspect of the disclosure is directed to a refinement of the sublimation paper wrapping and clamping device 6. According to one embodiment as illustrated in FIGS. 13 and 14, the sublimation paper wrapping and clamping device 6 includes two symmetrical pairs of X-shaped rocker arms 601, 602 hinged on a middle frame 603. Additionally, the bottoms of the two pairs of X-shaped rocker arms 601, 602 are each respectively connected to two bottom beams 604, 605. As shown in FIGS. 13 and 14, a push-pull device or actuator 606 is hinged between the two bottom beams 604, 605, and the top ends of the two pairs of X-shaped rocker arms are provided with hooks 602-1 that are engageable to the straight support rods 701-1 and 701-2. The view shown in FIG. 13 is when the sublimation paper wrapping and clamping device 6 is closed, while the view shown in FIG. 14 is when the sublimation paper wrapping and clamping device 6 is opened.

The sublimation paper wrapping and clamping device 6 includes the middle frame 603 that is fixed below the sublimation paper conveyor belt 1, as well as the two pairs of X-shaped rocker arms 601, 602 hinged to the middle frame 603 in a symmetrical relationship. The bottoms of the two pairs of X-shaped rocker arms 601, 602 are connected a bottom beam and are hinged with the middle frame to form a whole. The push-pull device is hinged between the front and back bottom beams 604, 605. The two X-shaped rocker arms 601, 602 can pass through the space between the chain links of the sublimation paper conveyor belt 1 by the actuation of the push-pull device or actuator 606. For a given pair of the X-shaped rocker arms 601, 602, each arm has a hook that face each other. The hook is contemplated to engage the exposed ends of the straight support rods 701-1, 701-2 on the two ends of the elastic fastening jacket 701 on the sublimation paper conveyor belt 1, and make a movement around the outer circumference of the workpiece under the action of the rocker arm 601, 602.

Before operating, the actuator rod of the push-pull device 606 is fully extended thus pushing the two X-shaped rocker arms 601, 602 to a position close to a horizontal opening, and hooks are engaging the straight support rods 701-1 and 701-2 from below on both ends of the elastic fastening jacket 701, as shown in FIG. 9. When operating, the horizontal transposition push rod 5 pushes the workpiece 13 on to the workpiece conveyor belt 3 and the elastic fastening jacket 701, on which the sublimation paper 14 that has been placed. At this time, the horizontal transposition push rod 5 is understood to be equivalent to a locator to fix the workpiece 13. Then, the rocker actuator or push-pull device 606 retracts, the two X-shaped rocker arms 601, 602 are raised while the four vertices thereof are retracted inwardly. The hooks that are engaged to the two straight support rods 701-1, 701-2 wrap the elastic fastening jacket 701 around the workpiece 13 by making a circular rotation around the same, until the elastic fastening jacket 701 and the sublimation paper 14 attached on it are tightly secured. At this time, the two straight support rods 701-1, 701-2 of the elastic fastening jacket 701 are pushed up, stretched toward each other, and fastened, as shown in FIG. 8. This completes the action of wrapping and clamping the elastic fastening jacket 701 to achieve the purpose of securing the sublimation paper 14 tightly to the outer cylindrical surface of the workpiece 13.

Ninth Aspect:

There is also contemplated a further refinement to the buckle installation device 9. The buckle installation device 9 of this embodiment includes: an automatic feeder 910 and a buckle feeding trough 911 that arrange the hooks neatly, and at least one pair of holders for grabbing the buckles 702 and fastening the same on to the two straight support rods 701-1, 701-2. The holders 912 are arranged above the feeding trough 911, and a vertical horizontal guide rail 913 and lateral horizontal guide rail 915 restrict the movement of the holders 912.

The buckle installation device 9 includes a manipulator 914. At least two pairs of grippers 917 are installed onto the manipulator 914. These two grippers respectively grab a buckle 702 and aim at the two ends of two straight support rods 701-1, 701-2 pulled tightly toward each other by the elastic fastening jacket 701 and inserted. Four or six grippers 917 can also be arranged on the head of the manipulator 914 to implement the operation of inserting buckles into multiple sublimation assemblies 905 at the same time, which improves work efficiency and increases output.

The automatic feeder arranges the buckles 702 neatly and transports them to the buckle feeding trough 911 for the holder 912 to obtain. The buckle feeding trough 911 is understood to be a temporary storage bin. The automatic feeder can use a vibrating conveyor to arrange the buckles and vibrate neatly into the buckle feeding trough.

Figure 16:
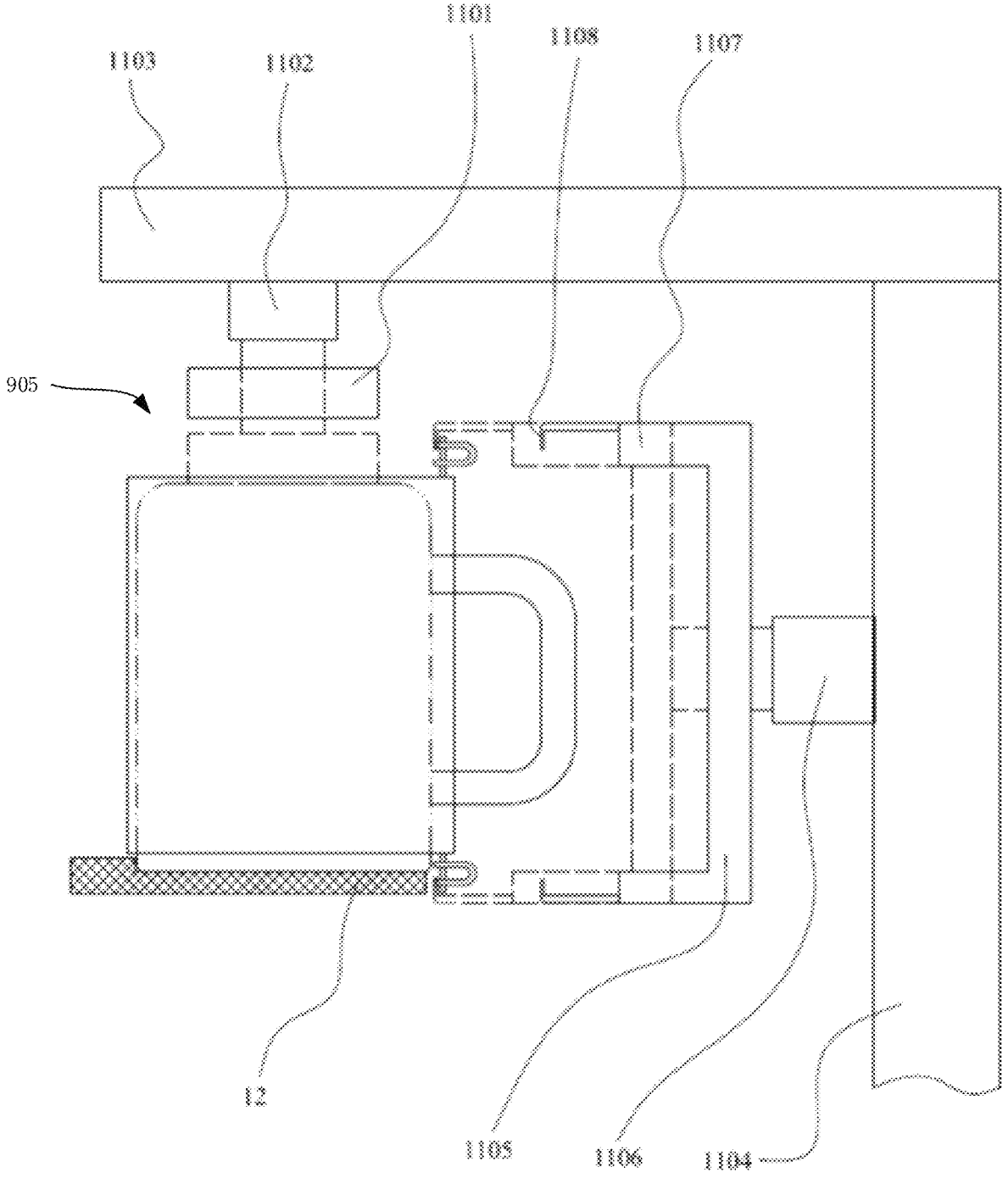
FIG. 16 is a front view of a buckle removing device showing details of a hook thereof according to an embodiment of the present disclosure, in which the hook faces inwardly relative to the workpiece.
Figure 17:
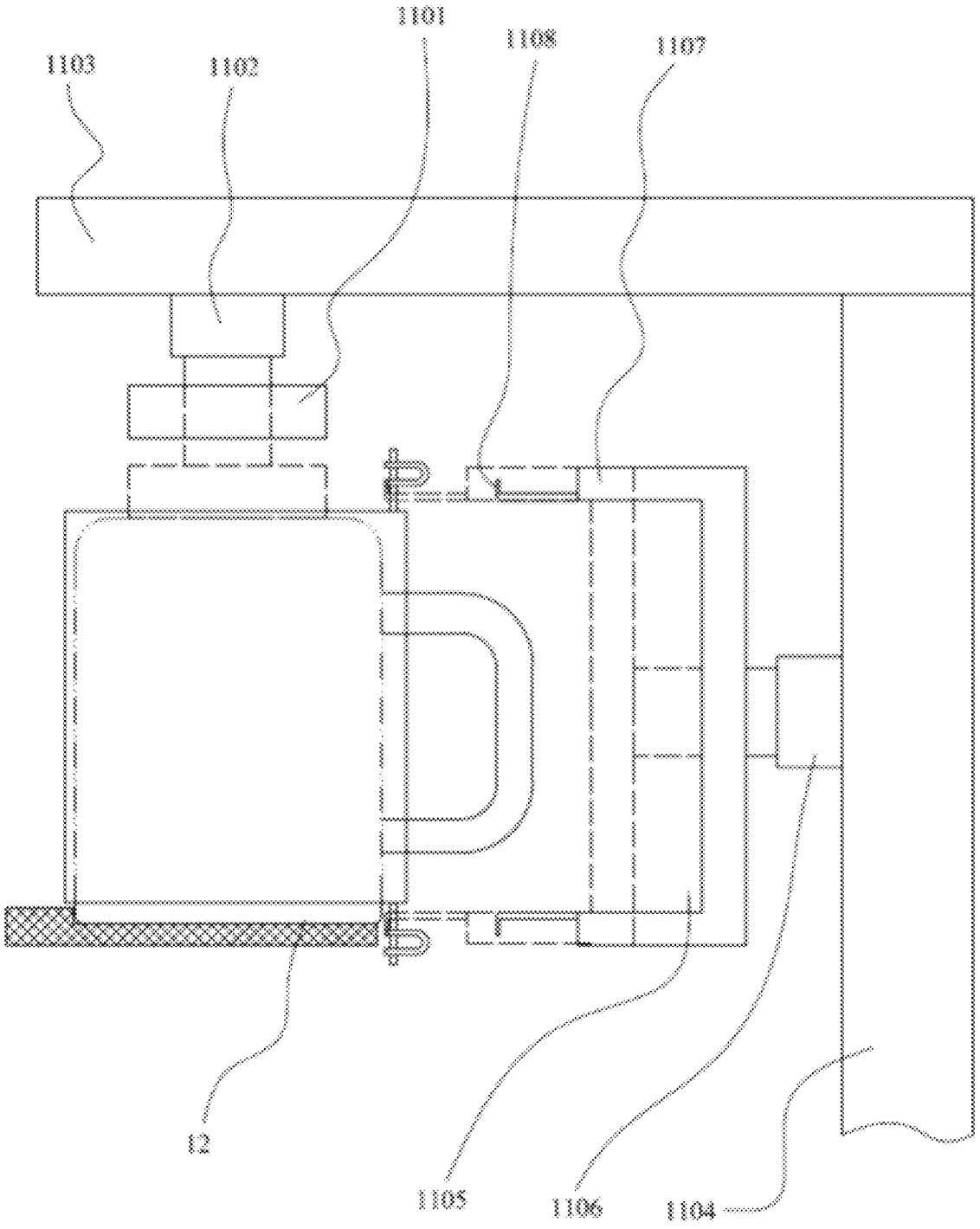
FIG. 17 is a front view of the buckle removing device showing details of the hook thereof according to another embodiment of the present disclosure, in which the hook faces outwardly relative to the workpiece.
Figure 18:
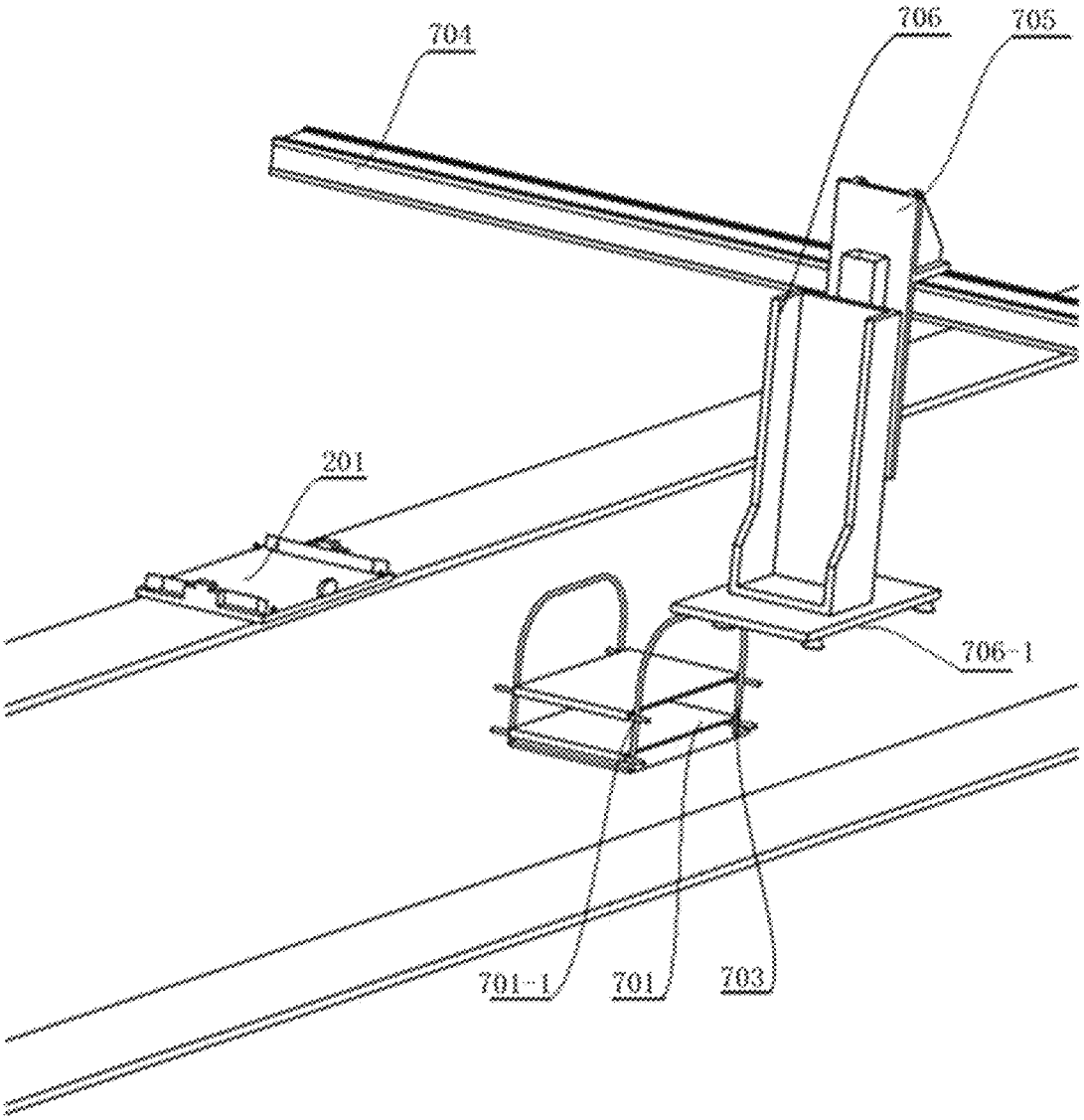
FIG. 18 is a front view of an elastic fastening jacket feeding device according to an embodiment of the present disclosure.
Figure 19:
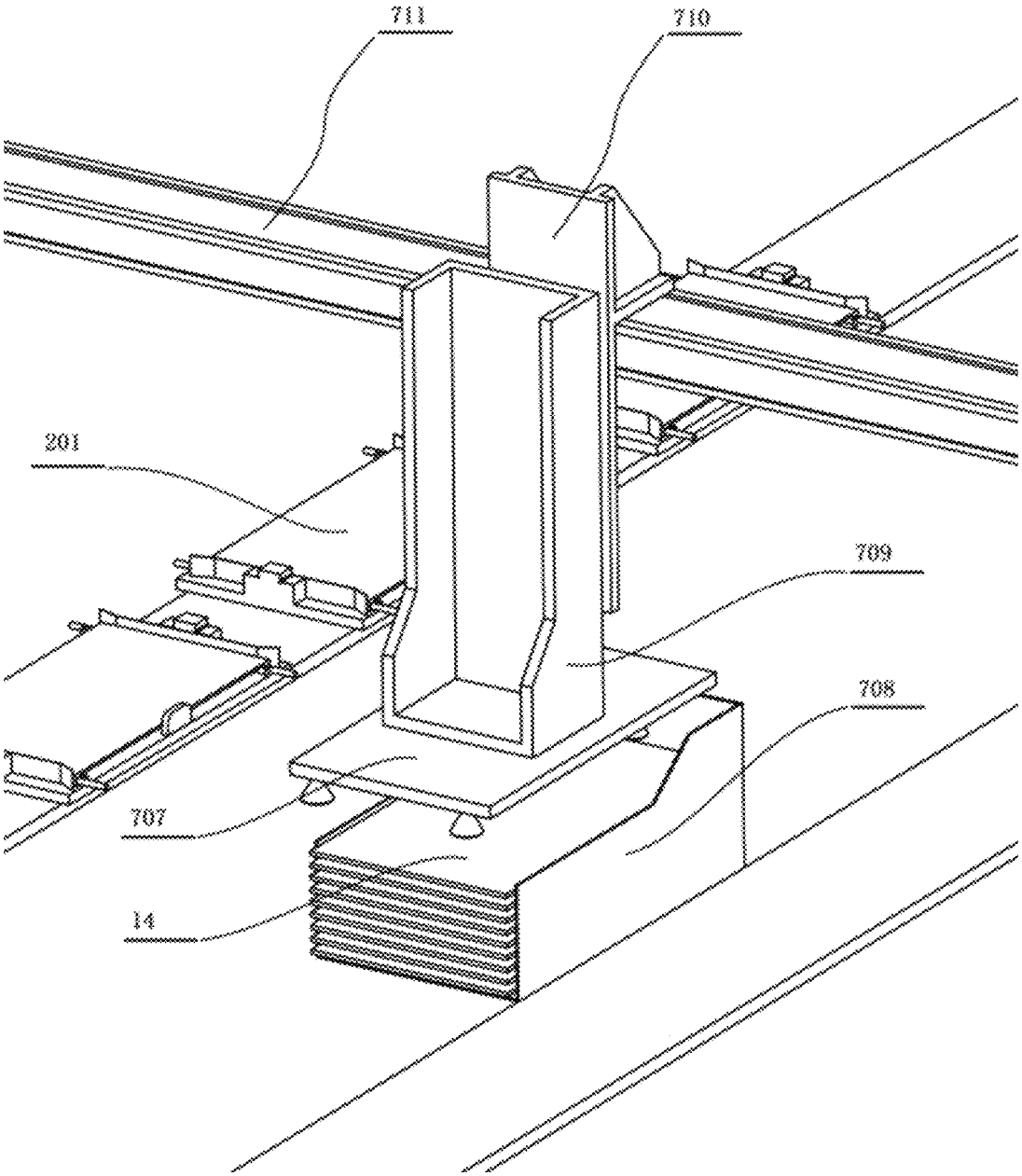
FIG. 19 is perspective view of a sublimation paper feeding device according to an embodiment of the present disclosure.

Tenth Aspect:

A refinement of the buckle removing device 11 is also contemplated in accordance with a tenth aspect of the present disclosure. The buckle removing device 11 may include a pressure block 1101 arranged above the finished product conveyor belt 12 for pressing the sublimation assembly 905. The pressure block 1101 may be connected to a pressure block expansion assembly 1102, with the pressure block expansion assembly being fixed on the buckle removing beam 1103. The buckle removing beam 1103 may be fixedly connected to a rod bracket 1104 provided on the side of the finished product conveyor belt 12. The rod bracket 1104 is provided with a buckle removing assembly 1106 that can drive the buckle removing door frame 1105 to move left and right. As shown in FIGS. 16 and 17, the two door-shaped legs 1107 of the buckle removing door frame are respectively provided with hooks 1108 capable of hooking out the buckle.

The rod bracket 1104 may be on one side of the finished product conveyor belt 12. With the rod bracket 1104 vertically set up, it may be fixedly connected with the buckle removing beam 1103 to defined an inverted L shape. The inverted L-shape is a cantilever beam structure, and a double-column structure can also be adopted, that is, two vertical columns are connected across the finished product conveyor belt 12 by a buckle removing beam 1103, and the force on it may be better than that of an inverted L-shaped support. Due to the small force, the buckle removing assembly 1106 on the rod bracket 1104 may simply use only the push-pull device, and the retraction and guiding action of the push-pull device can directly control the left and right movement of the buckle removing door frame. The structure of guide rail and servo electric cylinder can also be adopted to make the left and right movement of the buckle removing door frame more stable and reliable. One end of the retraction assembly is fixed on the rod bracket, and the other end is connected with the buckle removing door frame. The buckle removing door frame is a door-shaped body, the distance between the two legs of the door-shaped shape is equal to the distance between the two buckles on the revolving body sublimation assembly, and the top of the two legs of the door-shaped legs are respectively provided with two hooks, the buckle removing door frame is stretched forward, these two hooks will be inserted into the lower end of the buckle to hook the buckle. When the buckle removing door frame is stretched outwards, the buckles may be pulled out from the two straight support rods 701-1, 701-2 to separate the two to complete the buckle removal.

The hook can be bent inward, as shown in FIG. 16, or outward, as shown in FIG. 17. The dashed line in FIG. 16, 17 shows the state when the hooks are hooking on the buckle 702.

Eleventh Aspect:

A further aspect of the present disclosure relates to the elastic fastening jacket feeding device 7 described above. The elastic fastening jacket feeding device 7 may include a horizontal guide rail 704 fixed between the feeding tray 703 and the sublimation paper conveyor belt 1. The horizontal guide rail is provided with a slide track hanger 705 that can move along the horizontal guide rail. As shown in FIG. 17, the slide track hanger is equipped with a mechanical arm 706 that can move up and down along the slide track hanger, there are at least two vacuum suction cups 706-1 on the top of the mechanical arm to grab the elastic fastening leather.

The elastic fastening jacket feeding device 7 is not only suitable for feeding the elastic fastening jacket 701, but also suitable for feeding the sublimation paper 14. The elastic fastening jacket feeding device 7 is placed before the sublimation paper feeding device 8. The elastic fastening jacket 701 and the sublimation paper 14 are respectively stacked in their respective feeding trays 703 and 709. The mechanical arm 706 with vacuum suction cup 706-1 is set on the horizontal guide rail. The mechanical arms 706 and 710 are connected to the horizontal guide rails 704 and 712 through the slide tracks 705 and 711. There is a vertical slide track between the mechanical arms 706, 710 and the slide tracks 705, 711. Mechanical arms 706 realize vertical grasping and lateral transfer. The mechanical arm for grabbing the elastic fastening jacket 701 has at least four vacuum suction cups; the mechanical arm for grabbing the sublimation paper 14 has as least two vacuum suction cup, though this is by way of example only and not of limitation. The elastic fastening jacket feeding device 7 and the sublimation paper feeding device 8 are set up front and rear, or set up side by side. When set up side by side, the positions of the vacuum suction cups 706-1, 707 on the mechanical arms 706, 710 are adjusted accordingly. This design realizes the automatic feeding of the elastic fastening leather and the sublimation paper, reducing labor costs.

Twelfth Aspect:

This embodiment is a sublimation printing method for the outer cylindrical surface of the workpiece using the above-mentioned production line. The basic principle is to use two conveyor belts to respectively transfer workpiece and sublimation paper and elastic fastening leather for wrapping sublimation paper. Position the head of the horizontal transposition push rod to place the workpiece on the sublimation paper positioning facility. The sublimation paper wrapping and clamping device and the buckle installation device assemble the workpiece 13, sublimation paper 14, elastic fastening jacket 701 and buckles 702 together to form a revolving sublimation assembly. Put the sublimation assembly in the oven 10 for baking, and then remove the buckle 702 to disassemble the sublimation assembly to complete the sublimation printing process.

The specific steps of an exemplary method are as follows:

Step 1. Loading at the paper loading station: Run the workpiece conveyor belt 3 and the sublimation paper conveyor belt 1, place the elastic fastening jacket 701 and sublimation paper 14 on the sublimation paper by the elastic fastening jacket feeding device 7 and the sublimation paper feeding device 8 on the sublimation paper positioner 2 in order, the straight support rods 701-1 at both ends of the elastic fastening jacket 701 are placed on the outside the outer brace of the elastic fastening leather, the sublimation paper 14 is placed on the elastic fastening jacket 701 and stuck in the sublimation paper positioning piece 201-1.

The synchronous operation of the workpiece conveyor belt 3 and the sublimation paper conveying belt 1 means that the workpiece positioning setting and the sublimation paper positioning setting on the two conveying belts operate in one-to-one correspondence.

The workpiece is loaded by the manipulator or manually placed the workpiece on the revolving workpiece positioner 4 on the workpiece conveyor belt 3 to position the workpiece and ensure that the cup handle is vertically upward and the cup mouth is toward the workpiece the position where the workpiece lateral transposition push rod 5 can be inserted.

The elastic fastening jacket feeding device 7 set up next to the sublimation paper conveyor belt 1 puts the elastic fastening jacket 701 on the sublimation paper positioning device 2 of the sublimation paper conveyor belt 1 first, and then the sublimation paper 14 is placed on the elastic fastening jacket 701 by the sublimation paper feeding device 7. At this time, there is already a workpiece on the workpiece conveyor belt 3 corresponding to the installed elastic fastening leather and the sublimation paper.

Step 2, Push the cup into position: a sublimation paper positioning setting of the sublimation paper conveyor belt reach the position of the sublimation paper wrapping and clamping device, at the same time, the revolving conveyor belt also has a revolving outer cylindrical surface positioning device that is also aligned with the position of the sublimation paper wrapping and clamping device. At this time, the workpiece on the workpiece conveyor belt is pushed to the sublimation paper positioning device on the sublimation paper conveyor belt by the workpiece end surface positioning and pushing facility, then perform end face positioning.

The position of the workpiece wrapping and clamping device 6 is a very critical position, and the workpiece lateral transposition push rod 5 is provided at this position. The tightening chuck of the head of the workpiece lateral transposition push rod 5 is inserted into a workpiece on the workpiece conveyor belt 3 and tightened, and then the workpiece is pushed towards the sublimation paper positioner 2 on the sublimation paper conveyor belt 1. In the middle of the sublimation paper positioner 2 is provided with a workpiece horizontal pushing positioning block to limit the lateral stroke of the workpiece, which is to position the left and right positions of the workpiece, and the head of the workpiece lateral transposition push rod 5 is used for positioning the front and back positions of the workpiece. These two positioning are very important, mainly to align the left and right side extensions of the two straight support rods 701-1 of the elastic fastening leather with the hooks 602-1 on the X-shaped rocker arm, so as to make the hook 602-1 hook on the straight support rod 701-1 in step 3, so that the X-shaped rocker arm drags the two straight support rods of the elastic fastening leather to encircle the outer circle of the workpiece. If there is a cup handle on the workpiece, you need to position the cup handle so that the cup handle is vertically upward to avoid the two pairs of X-shaped rocker arms of the clamping device, so that the two straight support rods of the fixed leather are accurately placed on both sides of the cup handle.

Step 3. Paper loading and fastening: the sublimation paper wrapping and clamping device 6 is activated, the X-shaped rocker arm 601, 602 drags the two straight support rods 701-1 of the elastic fastening jacket 701 to encircle the outer circle of the workpiece to make the sublimation paper on the elastic fastening jacket 701 tightly attach to the outer surface of the workpiece, the buckle installation device 9 clamps the notches of the two shaped 702 buckles to the two straight support rods 701-1 of the elastic fastening leather to maintain the two straight support rods 701-1 on both sides of the rotating body auxiliary positioning mold, forming a sublimation printing assembly. Thereafter, the workpiece lateral transposition push rod 5 is withdrawn, and the workpiece sublimation printing assembly drops onto the sublimation paper conveyor belt 1 and continues to move forward.

The hook 602-1 at the top of the X-shaped rocker arm hooks the left and right extensions of the two straight support rods 701-1, so that the X-shaped rocker arms 601 and 602 drags the two straight support rods of the elastic fastening jacket 701 to encircle the outer circle of the workpiece. When the X-shaped rocker arms 601 and 602 drags the two straight support rods of the elastic fastening leather to encircle the outer circle of the workpiece, the two elastic fixed leather straight support rods 701-1 are driven and tightened by the hook 602-1 to make the elastic fastening jacket 701 generates a pre-force that automatically expands outward. This pre-force is very useful. On the one hand, when the buckle 702 clamps the straight support rod 701-1, the two straight support rods 701-1 have an outward tendency. The notch of the buckle 702 restricts the outward tendency of the two straight support rods 701-1, which is the opposite force of the pre-force expansion of the elastic fastening jacket 701. The balance between the two makes the elastic fastening jacket 701 keep the wrapping state of the external cylindrical surface. On the other hand, when the buckle is removed, as long as the buckle 702 is separated from the two straight support rods 701-1, the elastic fastening jacket 701 can be automatically unfolded without mechanical or manual peeling, which is very convenient. The most important thing is that this pre-force provides the sublimation paper 14 with pressure to tightly surround the outer cylindrical surface of the workpiece. This pressure is very important for a clear sublimation image. If there is no such pressure or insufficient pressure, the sublimation image will be not clear, reduce sublimation quality.

The buckle 702 is a very small part, only the size of a thumb. After the transfer process is to neatly arranged like a bullet chain, the mechanical arm is used to grab and insert between the two elastic fastening leather straight support rods 701-1 and clamp the two straight support rods 701-1. The small parts provide great convenience for automatic loading and unloading. The buckle 702 has a very simple shape and is convenient to manufacture. It can be produced by stamping and forming at one time, with high efficiency and low cost.

Steps 2 and 3 are completed at once in actual operation, that is, the workpiece is positioned by the horizontal transposition push rod 5, and the workpiece is pushed to the sublimation paper positioning facility, and the sublimation paper wrapping and clamping device 6 performs wrapping and clamping action, the buckle 702 clamps the left and right ends of the straight support rod 701-1 to form a revolving sublimation assembly. Several actions are completed in less than one second. Therefore, in order to improve efficiency, a system consisting of multiple sets of workpiece lateral transposition push rods and sublimation paper wrapping and clamping devices can be installed beside the two conveyor belts, and perform steps 2 and 3 at the same time, in this way can complete multiple workpiece sublimation assembly at the same time to achieve higher efficiency.

Step 4, Heat sublimation printing: The transfer facility transfers the sublimation mug assembly with sublimation paper to the mesh belt of the tunnel-type stainless steel mesh electric heating furnace at the baking station. The mesh belt of the tunnel-type stainless steel mesh electric heating furnace carries the sublimation printing assembly through the oven after several minutes, as shown in FIG. 1, and heats up to complete the image transfer.

In this step, a continuous baking method is adopted, and the sublimation assembly is placed on a steel wire mesh conveyor belt and slowly moves through the oven 10. In the oven 10, the sublimation assembly is baked by infrared heating, and the sublimation assembly continues to move forward while baking until it exits the oven 10.

Step 5, Paper removal: The sublimation printing facility transfers the transferred assembly to the finished product conveyor belt 12. The press block retraction assembly of the buckle removing device 11 set beside the finished product conveyor belt 12 presses down the press block, press down a sublimation printing assembly, at the same time, the buckle removing assembly pushes the buckle door frame forward. Insert the two hooks on the buckle removing door frame to the bottom of the notch of the buckle. The buckle removing assembly retracts, and the buckle is pulled out from the two straight support rods, so that the two straight support rods 701-1 lose their restraint, the elastic fastening jacket 701 is automatically unfolded under the action of elasticity, so that the sublimation paper 14 is separated from the workpiece 13, and the paper is removed.

The efficiency of disassembly in this step is also very high, and it can be completed within one second. Therefore, just like assembling the sublimation assembly, multiple systems can be set up at the same time to remove the paper, and multiple sublimation assemblies can be disassembled at the same time, so as to improve efficiency.

For the finished product unloading device, cameras and robotic arms may be utilized replace labor, which greatly reduces labor.

Finally, it should be noted that the above description is only used to illustrate the technical solutions of the present invention and not to limit them. Although the present invention has been described in detail with reference to the preferred layout, those having ordinary skill in the art would understand that the technical solutions of the present invention (such as the form and structure of the belt conveyor, the structure of each device, the arrangement of the production line, etc.) can be modified or equivalently replaced without departing from the spirit and scope of the present disclosure.

What is claimed is:

1. A sublimation printing production line for a plurality of workpieces, comprising:

a workpiece conveyor belt including one or more workpiece positioners holding a corresponding one of the plurality of workpieces;

a sublimation paper conveyor including one or more sublimation paper positioners each holding a given one of a plurality of sublimation paper sheets, a given one of a plurality of elastic fastening jackets, and a given one of the plurality of workpieces positioned on to the sublimation paper sheet and a given one of the elastic fastening jackets to define a sublimation assembly, the sublimation paper positioners corresponding to the one or more workpiece positioners on the workpiece conveyer and the sublimation paper conveyer moving synchronously and in parallel;

a sublimation paper wrapping and clamping device coupled to the sublimation paper conveyer, the given one of the sublimation paper sheets and the given one of the elastic fastening jackets being wrapped around the given one of the workpiece with ends of the elastic fastening jackets being coupled together with buckles;

a baking station coupled to the sublimation paper conveyor; and a sublimation assembly dismantling station connected to the baking station.

2. The sublimation printing production line of claim 1, wherein:

the given one of the elastic fastening jackets is defined by an elastic sheet with end portions each including a support rod fixed thereto.

3. The sublimation printing production line of claim 2, wherein the buckles are bent plates each with end portions defining a U-shaped notch, the buckles being engageable to the support rods of the given one of the elastic fastening jackets to retain the given one of the sublimation paper sheets to the corresponding one of the workpieces.

4. The sublimation printing production line of claim 3, further comprising:

at least one buckle installation device, the buckles being coupled to the support rods of the elastic fastening jacket thereby.

5. The sublimation printing production line of claim 4, wherein the buckle installation device includes an automatic feeder and a feeding trough that arrange the buckles, and at least one pair of holders for capturing and fastening the buckles on to the support rods.

6. The sublimation printing production line of claim 5, wherein the buckle installation device includes a horizontal guide rail and a lateral guide rail that restricts the movement of the holders.

7. The sublimation printing production line of claim 2, wherein the sublimation paper wrapping and clamping device is defined by symmetrical pairs of rocker arms hinged on a middle frame, with a bottom of the rocker arms being connected to a respective one of bottom beams with an actuator coupled thereto, and a top of the rocker arms including hooks engageable to a corresponding one the support rods.

8. The sublimation printing production line of claim 1, wherein the workpiece positioner includes cylindrical rollers positioned adjacently to each other and holds the workpiece, a rotation of the cylindrical rollers being translated to a corresponding rotation of the workpiece.

9. The sublimation printing production line of claim 1, further comprising:

an elastic fastening jacket feeding device coupled to the sublimation paper conveyor.

10. The sublimation printing production line of claim 1, further comprising:

a sublimation paper feeding device coupled to the sublimation paper conveyer.

11. The sublimation printing production line of claim 1, further comprising:

a workpiece end face positioning and pushing device engageable to the workpiece conveyer and the sublimation paper conveyer, the given one of the plurality of workpieces being transported to the sublimation paper conveyer by the workpiece end face positioning and pushing device.

12. The sublimation printing production line of claim 9, wherein the workpiece end face positioning and pushing device includes a horizontal transposition push rod with a tension chuck on a head portion thereof, and an end face positioning block engageable in an abutting relationship to the given one of the workpieces when transported to the sublimation paper conveyer.

13. The sublimation printing production line of claim 9 wherein the tension chuck is sized and shaped to be received in an open end of the workpiece.

14. The sublimation printing production line of claim 1, further comprising:

a sublimation paper positioning tray including a sublimation paper positioning piece and a positioning block outside the outside the positioning piece, at least one inner corner of the sublimation paper positioning tray including elastic fastening jacket outer braces, and at least one workpiece horizontal pushing and positioning block.

15. The sublimation printing production line of claim 1, further comprising:

a finished product conveyer belt coupled to the baking station;

wherein the sublimation assembly dismantling station is coupled to the finished product conveyer belt.

16. The sublimation printing production line of claim 15, further comprising:

a buckle removing device including a pressure block connected with a pressure block retraction assembly fixed to a buckle removal beam fixedly attached to a rod bracket on the side of the finished product conveyer belt.

17. The sublimation printing production line of claim 16, wherein the rod bracket includes a buckle unloading assembly driving a buckle unloading door frame to move laterally, each leg of the buckle unloading door frame including hooks engageable to the buckle.

* * * * *